US009783380B2

(12) United States Patent
Kuriki

(10) Patent No.: US 9,783,380 B2
(45) Date of Patent: Oct. 10, 2017

(54) SHEET FEEDER, SHEET FEEDING ASSEMBLY, AND METHOD OF MOUNTING SHEET FEEDING ASSEMBLY IN SHEET FEEDER

(71) Applicant: BROTHER KOGYO KABUSHIKI KAISHA, Nagoya-shi, Aichi-ken (JP)

(72) Inventor: Yuichiro Kuriki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/276,082

(22) Filed: Sep. 26, 2016

(65) Prior Publication Data

US 2017/0088374 A1 Mar. 30, 2017

(30) Foreign Application Priority Data

Sep. 30, 2015 (JP) ..... 2015-195232

(51) Int. Cl.

| | |
|---|---|
| ***B65H 3/06*** | (2006.01) |
| ***B65H 3/52*** | (2006.01) |
| ***B65H 5/06*** | (2006.01) |

(52) U.S. Cl.

CPC ..... *B65H 3/0669* (2013.01); *B65H 3/06* (2013.01); *B65H 3/063* (2013.01); *B65H 3/0638* (2013.01); *B65H 3/0661* (2013.01); *B65H 3/5284* (2013.01); *B65H 5/062* (2013.01); *B65H 2403/70* (2013.01); *B65H 2404/134* (2013.01); *B65H 2404/17* (2013.01)

(58) Field of Classification Search

CPC ..... B65H 3/06; B65H 3/0669; B65H 3/0638; B65H 3/0661; B65H 3/5284; B65H 3/34; B65H 2601/324; B65H 2403/70; B65H 2403/17; B65H 2403/134; B65H 5/062

See application file for complete search history.

(56) References Cited

U.S. PATENT DOCUMENTS

| | | | | |
|---|---|---|---|---|
| 2014/0179500 | A1 | 6/2014 | Shimosaka | |
| 2017/0088373 | A1* | 3/2017 | Tahara | B65H 3/0669 |

FOREIGN PATENT DOCUMENTS

| | | | |
|---|---|---|---|
| JP | 2000-128368 | A | 5/2000 |
| JP | 2007-119082 | A | 5/2007 |
| JP | 2014-122087 | A | 7/2014 |

* cited by examiner

*Primary Examiner* — Luis A Gonzalez
(74) *Attorney, Agent, or Firm* — Merchant & Gould P.C.

(57) ABSTRACT

A sheet feeder includes: a sheet feeding assembly including: a shaft having an insertion part; and a feed roller; and a main body including: a rotary part; and first and second bearings. The main body supports the sheet feeding assembly. The rotary part rotates upon transmission of a drive force and receives the insertion part. The bearings support the shaft. An opening of an open portion of the first bearing has a circumferential dimension greater than a diameter of the shaft. The shaft supported by the bearings is movable between a mounted position and a retracted position. The feed roller is supported by the shaft, and movable as the shaft moves between the mounted position and the retracted position. The insertion part is separated from the rotary part when the shaft is in the retracted position, and inserted into the rotary part to place the shaft in the mounted position.

14 Claims, 18 Drawing Sheets

SHEET FEEDER, SHEET FEEDING ASSEMBLY, AND METHOD OF MOUNTING SHEET FEEDING ASSEMBLY IN SHEET FEEDER

CROSS REFERENCE TO RELATED APPLICATION

This application claims priority from Japanese Patent Application No. 2015-195232 filed Sep. 30, 2015. The entire content of the priority application is incorporated herein by reference.

TECHNICAL FIELD

The present disclosure relates to a sheet feeder.

BACKGROUND

A sheet feeder that feeds sheets is well known in the art. One such sheet feeder known in the art is provided with a tray, a friction pad, a feed roller, a bracket, and a drive source. The tray holds sheets of paper, for example. The friction pad is disposed on the tray. The feed roller is disposed in confrontation with the friction pad. Shaft parts are formed on both ends of the feed roller. The bracket includes two bearings formed of an elastic material. The bearings rotatably support the shaft parts of the feed roller. The drive source transmits a drive force to the feed roller through a plurality of gears. When the feed roller is driven to rotate in a prescribed direction serving as a sheet-feeding direction, the feed roller feeds one sheet of paper stacked in the tray downstream in a conveying direction.

An opening is formed in each of the two bearings. A user mounts and removes the shaft parts relative to the corresponding bearings by spreading the openings in the corresponding bearings wider. Hence, the user can mount and remove the feed roller relative to the bracket. When the feed roller has reached the end of its service life, the user can replace the old feed roller with a new feed roller.

SUMMARY

According to one aspect, the disclosure provides a sheet feeder including: a sheet feeding assembly; and a main body. The sheet feeding assembly includes: a shaft; a feed roller; a lever; and a first one-way clutch. The main body supports the sheet feeding assembly. The main body includes: a reverse roller; a first contact part; a rotary part; a first bearing; a second bearing; and an indentation wall. The shaft is configured to rotate about a rotation axis extending in an axial direction. The shaft has one end portion and another end portion in the axial direction. The one end portion has an insertion part. The insertion part includes a prescribed surface and a circumferential surface. The prescribed surface crosses in a radial direction of the shaft. The prescribed surface has one end extending in the axial direction and another end extending in the axial direction. The circumferential surface extends in a circumferential direction of the shaft from the one end of the prescribed surface and the another end of the prescribed surface. A distance in the radial direction from the rotation axis to a portion of the prescribed surface except for the one end of the prescribed surface and the another end of the prescribed surface is smaller than a distance in the radial direction from the rotation axis to the circumferential surface. The feed roller is supported by the shaft and configured to rotate in a sheet-feeding direction.

The lever is disposed at the another end portion of the shaft. The feed roller is positioned between the insertion part and the lever in the axial direction. The lever includes a grip part extending in the radial direction. The first one-way clutch allows the lever to idly rotate relative to the shaft in a sheet-returning direction opposite to the sheet-feeding direction. The reverse roller faces the feed roller and is configured to rotate in the sheet-returning direction. The first contact part is positioned downstream relative to the grip part in the sheet-returning direction and contacting the grip part. The rotary part is configured to rotate about the rotation axis upon transmission of a drive force. The rotary part includes a hole portion and a first wall. The hole portion is configured to receive the insertion part. The first wall is configured to contact the prescribed surface but to be separated from the circumferential surface when the insertion part has been inserted into the hole portion. The rotary part has one end and another end in the axial direction. The one end of the rotary part is closer to the feed roller than the another end of the rotary part to the feed roller in the axial direction. The first bearing is disposed between the feed roller and the rotary part in the axial direction. The first bearing includes an open portion having an inner curved surface on which the shaft is rotatably supported. An opening of the open portion has a dimension in the circumferential direction greater than an outer diameter of the shaft. The second bearing is disposed opposite to the first bearing and the rotary part with respect to the feed roller in the axial direction. The second bearing supports the shaft at a position between the feed roller and the lever. The shaft is slidable in the axial direction relative to the second bearing. The indentation wall is disposed opposite to the feed roller with respect to the second bearing in the axial direction. The indentation wall is indented in the radial direction and extending in the axial direction. The indentation wall has one end and another end in the axial direction. The one end of the indentation wall is farther from the feed roller than the another end of the indentation wall from the feed roller in the axial direction. A distance from the one end of the indentation wall to the one end of the rotary part is greater than a dimension of the shaft in the axial direction. The shaft is configured to be slidingly movable in the axial direction between a mounted position and a retracted position while the shaft is supported by the fist bearing and the second bearing. The feed roller and the lever move in the axial direction in conjunction with the sliding movement of the shaft between the mounted position and the retracted position. The insertion part is separated in the axial direction from the hole portion when the shaft is in the retracted position. The insertion part is inserted into the hole portion to allow the shaft to be placed in the mounted position.

According to another aspect, the disclosure provides a sheet feeding assembly configured to be mounted in a main body of a sheet feeder. The sheet feeding assembly includes: a shaft; a roller; a lever; a first one-way clutch; and a second one-way clutch. The shaft is configured to rotate about a rotation axis extending in an axial direction. The shaft has one end portion and another end portion in the axial direction. The one end portion has an insertion part. The insertion part includes a prescribed surface and a circumferential surface. The prescribed surface faces in a radial direction of the shaft. The prescribed surface has one end extending in the axial direction and another end extending in the axial direction. The circumferential surface extends in a circumferential direction of the shaft from the one end of the prescribed surface and the another end of the prescribed surface. A distance in the radial direction from the rotation axis to a portion of the prescribed surface except for the one end of the prescribed surface and the another end of the prescribed surface is smaller than a distance in the radial direction from the rotation axis to the circumferential surface. The roller is supported by the shaft and configured to rotate in a sheet-feeding direction. The lever is disposed at the another end portion of the shaft. The roller is positioned between the insertion part and the lever in the axial direction. The lever includes: a grip part extending in the radial direction; and a locking arm positioned further downstream relative to the grip part in a sheet-returning direction opposite to the sheet-feeding direction. The locking arm includes a first extension part extending in the radial direction and a second extension part extending from the first extension part in a direction crossing the radial direction. The first one-way clutch allows the lever to idly rotate relative to the shaft in the sheet-returning direction. The second one-way clutch is disposed between the shaft and the roller in the radial direction. The second one-way clutch is configured to restrict the roller to idly rotate relative to the shaft in the sheet-returning direction.

According to still another aspect, the disclosure provides a method of mounting a sheet feeding assembly in a main body of a sheet feeder. The method comprises: (a) providing the sheet feeding assembly and the main body, the sheet feeding assembly comprising: a shaft configured to rotate about a rotation axis extending in an axial direction, the shaft having one end portion and another end portion in the axial direction, the one end portion having an insertion part, the insertion part including a prescribed surface and a circumferential surface, the prescribed surface crossing in a radial direction of the shaft, the prescribed surface having one end extending in the axial direction and another end extending in the axial direction, the circumferential surface extending in a circumferential direction of the shaft from the one end of the prescribed surface and the another end of the prescribed surface, a distance in the radial direction from the rotation axis to a portion of the prescribed surface except for the one end of the prescribed surface and the another end of the prescribed surface being smaller than a distance in the radial direction from the rotation axis to the circumferential surface, the shaft being configured to be movable in the axial direction between a mounted position and a retracted position; a feed roller supported by the shaft and configured to rotate in a sheet-feeding direction; a lever disposed at the another end portion of the shaft, the feed roller being positioned between the insertion part and the lever in the axial direction, the lever including: a grip part extending in the radial direction and having a first portion facing in the sheet-feeding direction; and a locking arm positioned further downstream relative to the grip part in a sheet-returning direction opposite to the sheet-feeding direction, the locking arm including a first extension part extending in the radial direction and a second extension part extending from the first extension part in a direction crossing the radial direction; and a first one-way clutch allowing the lever to idly rotate relative to the shaft in the sheet-returning direction; and the main body comprising: a reverse roller facing the feed roller and configured to rotate in the sheet-returning direction; a first contact part positioned downstream relative to the grip part in the sheet-returning direction and contacting the grip part; a rotary part configured to rotate about the rotation axis upon transmission of a drive force, the rotary part comprising: a hole portion configured to receive the insertion part; and a first wall configured to contact the prescribed surface but to be separated from the circumferential surface when the insertion part has been inserted into the hole portion, the rotary part having one end and another end in the axial direction, the one end of the rotary part being closer to the feed roller than the another end of the rotary part to the feed roller in the axial direction; a first bearing disposed between the feed roller and the rotary part in the axial direction, the first bearing including an open portion having an inner curved surface on which the shaft is rotatably supported, an opening of the open portion having a dimension in the circumferential direction greater than an outer diameter of the shaft; a second bearing disposed opposite to the first bearing and the rotary part with respect to the feed roller in the axial direction, the second bearing supporting the shaft at a position between the feed roller and the lever, the shaft being slidable in the axial direction relative to the second bearing; an indentation wall disposed opposite to the feed roller with respect to the second bearing in the axial direction, the indentation wall being recessed in the radial direction and extending in the axial direction, the indentation wall having one end and another end in the axial direction, the one end of the indentation wall being farther from the feed roller than the another end of the indentation wall from the feed roller in the axial direction, a distance from the one end of the indentation wall to the one end of the rotary part being greater than a dimension of the shaft in the axial direction, a distance from the indentation wall to the rotation axis in the radial direction being smaller than a distance from the second extension part to the rotation axis in the radial direction, the indentation wall has an aperture extending in the circumferential direction, the aperture being positioned between the locking arm and the feed roller in the axial direction when the shaft is in the retracted position, the aperture being aligned with the locking arm in the axial direction when the shaft is in the mounted position, the insertion part being separated in the axial direction from the hole portion when the shaft is in the retracted position, the insertion part being inserted into the hole portion to allow the shaft to be placed in the mounted position; and a cover configured to be pivotally movable between a closed position and an open position, the cover in the closed position covering the sheet feeding assembly in the radial direction, the cover in the open position exposing the sheet feeding assembly to an outside in the radial direction, the cover including a protrusion protruding in a direction from the open position to the closed position, the protrusion being configured to contact the first portion of the grip part; (b) placing the sheet feeding assembly in the main body so that the shaft is placed in the retracted position and supported by the first bearing and the second bearing; (c) moving the sheet feeding assembly in the axial direction while the shaft is supported by the first bearing and the second bearing so that the shaft is placed in the mounted position; and (d) moving the cover from the open position to the closed position, the protrusion pressing the first portion of the grip part to move the lever to the first pivot position in conjunction with the movement of the cover from the open position to the closed position, the grip part being in contact with the first contact part when the lever is in the first pivot position, the first extension part passing through the aperture in conjunction with the movement of the lever to the first pivot position, the second extension part being moved to a position opposite to the rotation axis with respect to the indentation wall in the radial direction in conjunction with the movement of the lever to the first pivot position.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
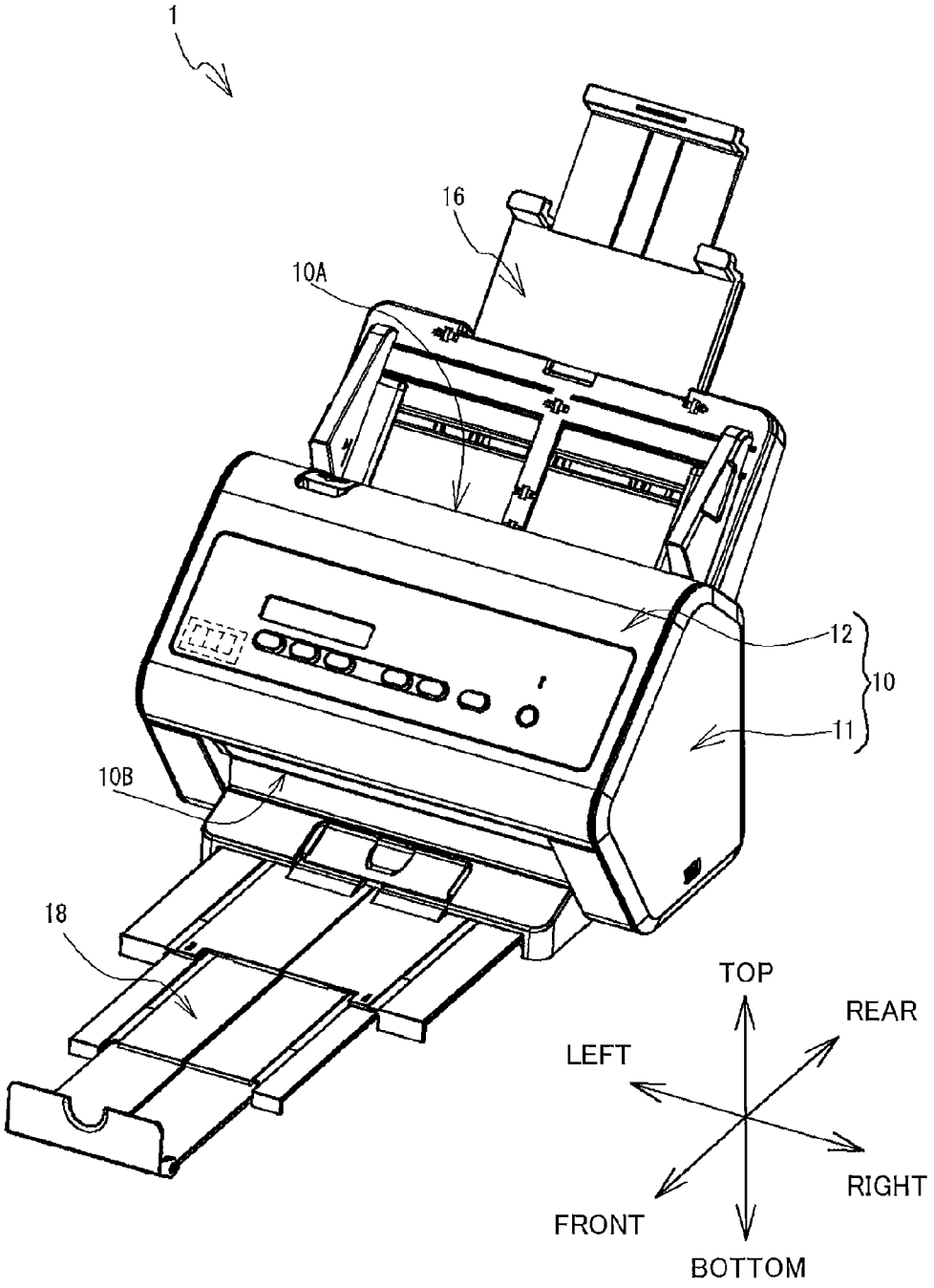
FIG. 1 is a perspective view of an image reading apparatus 1 according to one embodiment.

The conventional sheet feeder described above requires the user to spread the openings in the bearings wider when mounting the shaft parts therein and removing the shaft parts therefrom. Therefore, the user needs to overcome a large load when mounting and removing the feed roller (hereinafter referred to as a "mounting and removing load"). Thus, an operation for replacing the feed roller may not be easy. Here, one conceivable sheet feeder may have cutouts in the shaft parts of the feed roller in order to reduce the required mounting and removing load. When the user rotates the shaft parts to a specific rotated position (for example, when aligning the cutout portions with the openings in the bearings), the amount of deformation in the openings required for mounting the shaft parts in the bearings and removing the shaft parts from the bearings is reduced, thereby reducing the mounting and removing load.

It is conceivable to provide this sheet feeder with a reverse roller in place of the friction pad. With this configuration, the reverse roller rotates in a direction for urging sheets stacked in the tray upstream in the conveying direction. Sheets in the tray are fed downstream in the conveying direction by the feed roller and the reverse roller rotating in association with each other. However, backlash may exist among the plurality of gears provided for transmitting the drive force of the drive source to the feed roller. Consequently, when an upstream edge of the fed sheet in the conveying direction passes through a nip position between the feed roller and the reverse roller, the feed roller may be rotated along with the reverse roller in the direction opposite to the sheet-feeding direction (hereinafter referred to as a "sheet-returning direction") a distance corresponding to the backlash. In such cases, sheets remaining in the tray may be returned upstream in the conveying direction. This action could cause the sheets conveyed upstream and could damage downstream edges of the sheets in the conveying direction.

In order to prevent the feed roller from following the rotation of the reverse roller, the sheet feeder may have a lever provided on the shaft parts of the feed roller for restricting the shaft parts from rotating in the sheet-returning direction. The lever contacts a prescribed part of the bracket from a downstream side in the sheet-feeding direction thereof. This contact prevents the feed roller from rotating in the sheet-returning direction.

With the conventional sheet feeder described above, prior to mounting the feed roller in the bracket, the user must adjust the lever and the bracket to a prescribed positional relationship so that the lever will be able to contact the bracket. However, requiring such adjustment introduces a new problem; namely, that the user must further adjust the rotated positions of the shaft parts when their positions differ from the prescribed rotated positions, making the operation of mounting the feed roller more difficult.

In view of the foregoing, it is an object of the disclosure to provide a sheet feeder that is configured so that the user can easily mount the feed roller therein.

An image reading apparatus 1 as an example of a sheet feeder according to one embodiment will be described with reference to the accompanying drawings, wherein like parts and components are designated by the same reference numerals to avoid duplicating description.

In the following description, top, bottom, lower-left, upper-right, upper-left, and lower-right sides in FIG. 1 will be respectively referred to as top, bottom, front, rear, left, and right sides of the image reading apparatus 1. Further, clockwise and counterclockwise directions in the following description will denote rotating directions in a right side view.

Figure 2:
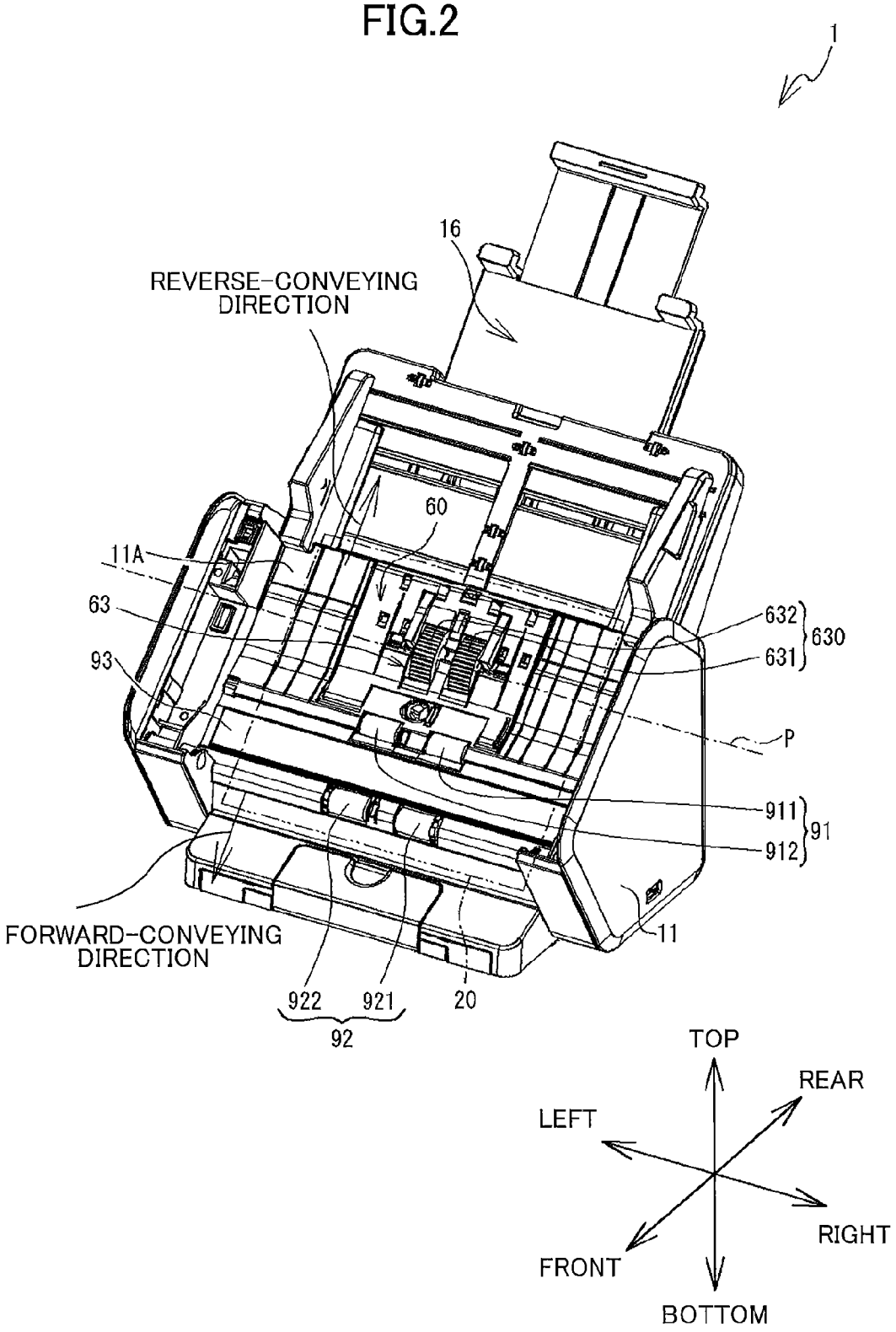
FIG. 2 is a perspective view of the image reading apparatus 1 from which a second casing 12 is omitted.

The general structure of the image reading apparatus 1 will be described with reference to FIGS. 1 and 2. As illustrated in FIGS. 1 and 2, the image reading apparatus 1 includes a casing 10, a sheet feeding tray 16, and a discharge tray 18. The image reading apparatus 1 feeds a plurality of sheets 35 (see FIGS. 17A and 17B) stacked on the sheet feeding tray 16 one at a time into the casing 10 and discharges the sheets 35 from the casing 10 onto the discharge tray 18. The image reading apparatus 1 can read images on the sheet 35 while the sheet 35 is conveyed through the casing 10. Note that, in FIG. 2, the discharge tray 18 is stored inside the casing 10, and a second casing 12 described later has been omitted.

The casing 10 includes a first casing 11 and the second casing 12. The first casing 11 has a box-shaped configuration forming a bottom portion of the casing 10. The first casing 11 has a top surface 11A. The top surface 11A slopes downward toward the front. The second casing 12 overlaps the first casing 11 from above. A bottom surface 12A of the second casing 12 (see FIG. 17) confronts the top surface 11A with a gap formed therebetween. The gap between the top surface 11A and the bottom surface 12A constitutes a conveying path 20. The conveying path 20 corresponds to a region through which the sheets 35 pass. Hereinafter, a direction extending along the conveying path 20 from the top of the conveying path 20 toward the bottom of the conveying path 20 will be referred to as a "forward-conveying direction," and a direction opposite to the forward-conveying direction will be referred to as a "reverse-conveying direction." Collectively, the forward-conveying direction and the reverse-conveying direction will be referred to as the "conveying direction."

A gap formed between a downstream edge in the reverse-conveying-direction of the top surface 11A of the first casing 11 and a downstream edge in the reverse-conveying-direction of the bottom surface 12A of the second casing 12 constitutes a feed opening 10A. A gap formed between a downstream edge in the forward-conveying-direction of the top surface 11A of the first casing 11 and a downstream edge in the forward-conveying-direction of the bottom surface 12A of the second casing 12 constitutes a discharge opening 10B. Both the feed opening 10A and the discharge opening 1 OB are elongated in a left-right direction.

The sheet feeding tray 16 has a plate-shaped configuration extending in the reverse-conveying direction from the downstream edge in the reverse-conveying-direction of the top surface 11A of the first casing 11. A plurality of sheets 35 can be stacked on the sheet feeding tray 16 (see FIG. 17). The discharge tray 18 has a plate-shaped configuration that extends forward from the downstream edge in the forward-conveying-direction of the top surface 11A of the first casing 11. Sheets 35 discharged through the discharge opening 10B are accumulated in the discharge tray 18.

Figure 3:
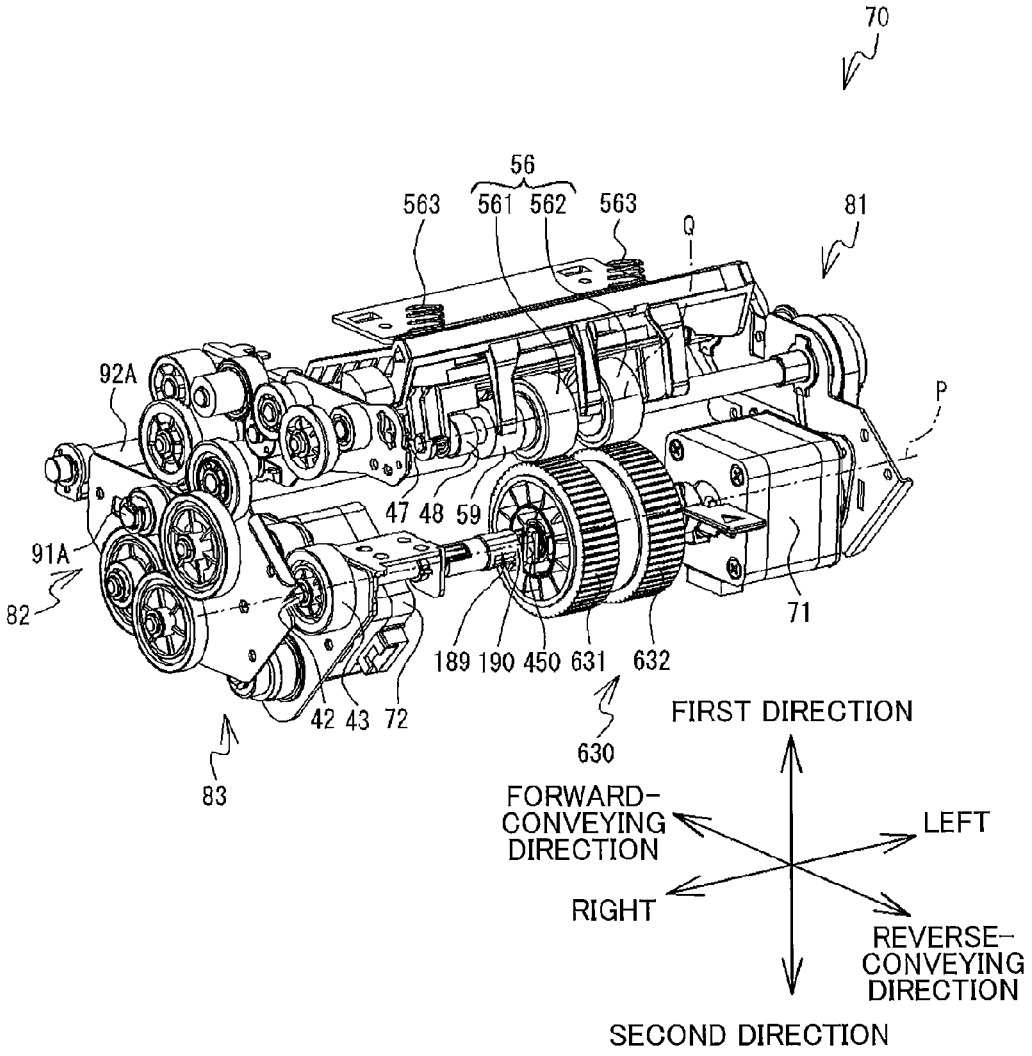
FIG. 3 is a perspective view of a drive mechanism 70.

As illustrated in FIGS. 2 and 3, a feed roller 630 is provided at the first casing 11. The feed roller 630 is rotatable about a rotation axis P. The rotation axis P is a virtual axis extending in the left-right direction and parallel to the conveying path 20. The feed roller 630 includes a right feed roller 631, and a left feed roller 632. The configuration of the feed roller 630 will be described later in detail.

In the following description, a circumferential direction in a cylindrical coordinate system whose reference axis is the rotation axis P will be simply be referred to as a "circumferential direction," and a radial direction from the rotation axis P will simply be referred to as a "radial direction." Further, a direction orienting from the first casing 11 toward the second casing 12 and orthogonal to the rotation axis P will be referred to as a "first direction," and a direction opposite to the first direction will be referred to as a "second direction." Both the first direction and the second direction are also the radial directions. Note that an axial direction in the cylindrical coordinate system having the rotation axis P as its reference axis is aligned in the left-right direction.

A conveying roller 91 is disposed on a downstream side relative to the feed roller 630 in the forward-conveying-direction. The conveying roller 91 is supported on a shaft 91A (see FIG. 3). The shaft 91A extends in the left-right direction and is rotatably supported by the first casing 11. The conveying roller 91 includes a right conveying roller 911, and a left conveying roller 912. A circumferential portion of each of the right conveying roller 911 and the left conveying roller 912 facing in the first direction protrudes into the conveying path 20 from the top surface 11A of the first casing 11.

A first reading unit 93 is disposed on a downstream side relative to the conveying roller 91 in the forward-conveying-direction. The first reading unit 93 is provided with a contact image sensor (CIS; not illustrated) arranged along the left-right direction. The first reading unit 93 reads an image of a bottom surface of the sheet 35 conveyed along the conveying path 20.

A conveying roller 92 is disposed on a downstream side relative to the first reading unit 93 in the forward-conveying-direction. The conveying roller 92 is supported on a shaft 92A (see FIG. 3). The shaft 92A extends in the left-right direction and is rotatably supported by the first casing 11. The conveying roller 92 includes a right conveying roller 921, and a left conveying roller 922. A circumferential portion of each of the right conveying roller 921 and the left conveying roller 922 facing in the first direction protrudes into the conveying path 20 from the top surface 11A of the first casing 11.

The feed roller 630, the conveying roller 91, and the conveying roller 92 are all rotatable in a sheet-feeding direction. The sheet-feeding direction is a rotating direction of the rollers for conveying the sheet 35 in the forward-conveying direction. The sheet-feeding direction of the feed roller 630 is one of the circumferential directions described above, and specifically a counterclockwise rotating direction about the rotation axis P. The sheet-feeding directions of the conveying rollers 91 and 92 are also counterclockwise rotating directions.

Figure 17A:
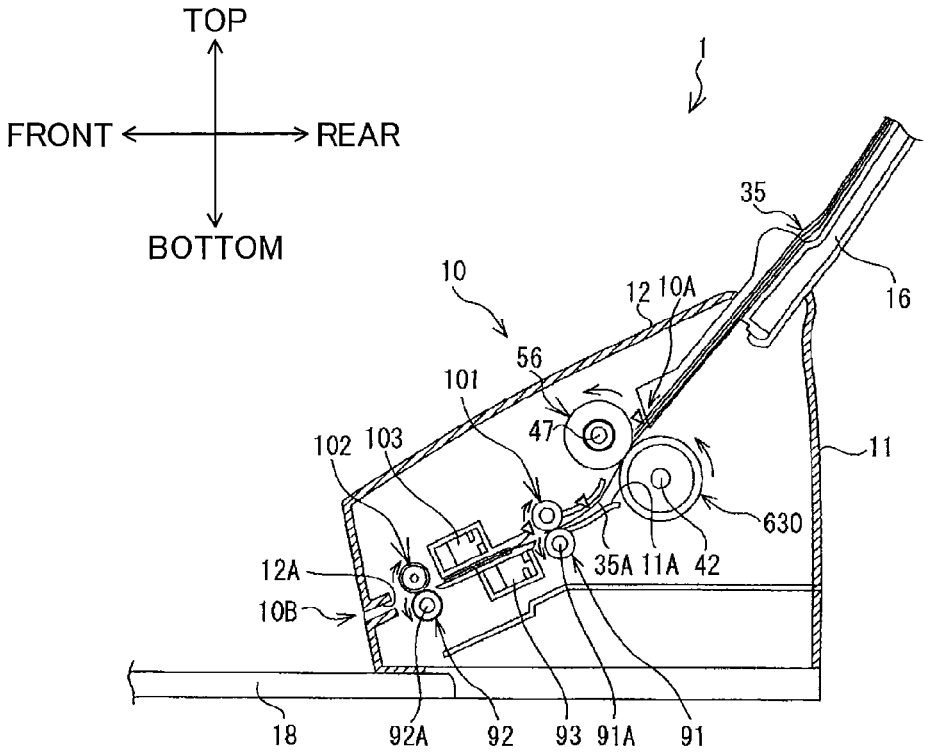
FIGS. 17A and 17B are explanatory views how the sheet 35 is fed in the image reading apparatus 1.
Figure 17B:
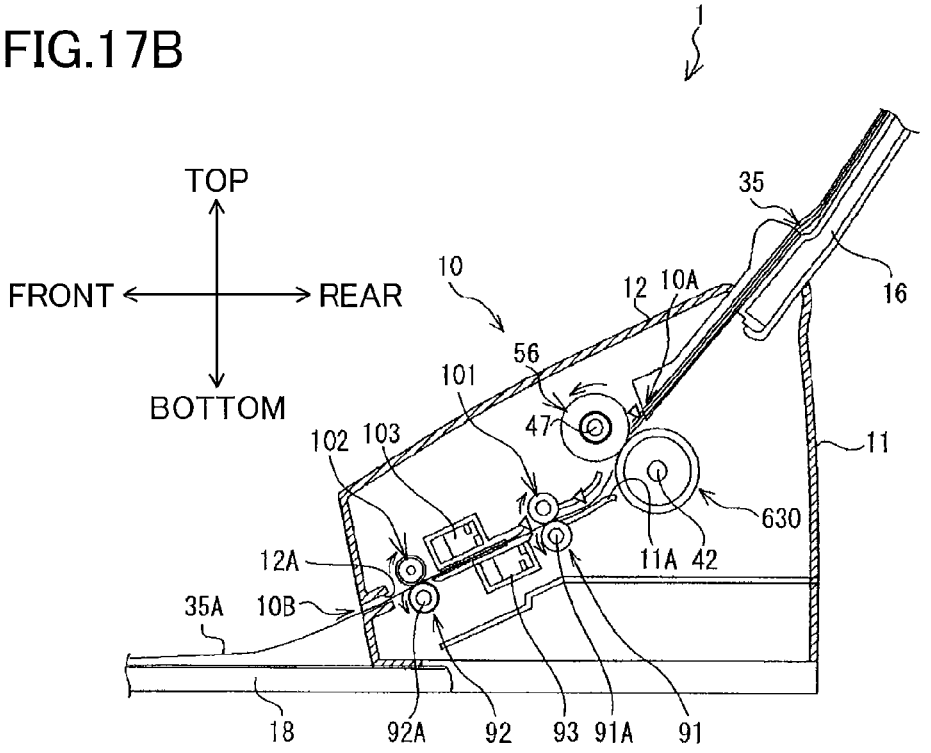

A reverse roller 56 is provided at the second casing 12 (see FIGS. 3, 17A, and 17B). The reverse roller 56 confronts the feed roller 630, with the conveying path 20 interposed therebetween. The reverse roller 56 is supported together with a torque limiter 59 on a shaft 47. The shaft 47 extends in the left-right direction and supported by the second casing 12. Hereinafter, an axis of the shaft 47 will be referred to as a "rotation axis Q." The reverse roller 56 can rotate in either rotating direction about the rotation axis Q. In other words, the reverse roller 56 can rotate in a sheet-returning direction which is a direction opposite to the sheet-feeding direction. The sheet-returning direction of the reverse roller 56 is a counterclockwise rotating direction about the rotation axis Q.

Below, a term "object" is used as a general term to refer to any member, any part, and any surface. In the following description, the "sheet-feeding direction" and the "sheet-returning direction" may be used for designating the direction in which an object rotates, as well as to designate the positional relationship between an object and another member or the like. In the latter case, the sheet-feeding direction referencing an object denotes the sheet-feeding direction relative to the object and the sheet-returning direction relative to a first position. The first position is a position displaced 180 degrees from the object in the sheet-feeding direction. Similarly, the sheet-returning direction referencing an object denotes the sheet-returning direction relative to the object and the sheet-feeding direction relative to the first position.

A gear 48 (see FIG. 3) is provided on the shaft 47. The gear 48 is coupled to a conveying motor 71 described later and the reverse roller 56. When driven by the conveying motor 71, the gear 48 rotates about the rotation axis Q and transmits torque to the torque limiter 59. The reverse roller 56 includes a right reverse roller 561, and a left reverse roller 562. A circumferential portion of each of the right reverse roller 561 and the left reverse roller 562 facing in the second direction protrudes into the conveying path 20 from the bottom surface 12A of the second casing 12. By the urging force of springs 563, the right reverse roller 561 and the left reverse roller 562 are respectively pressed against the right feed roller 631 and the left feed roller 632.

The torque limiter 59 transmits a drive force from the gear 48 to the reverse roller 56 when the torque acting on the reverse roller 56 is less than a prescribed threshold. Accordingly, when the torque acting on the reverse roller 56 is less than the prescribed threshold, the reverse roller 56 rotates in the sheet-returning direction in response to the torque received from the gear 48 acting to rotate the reverse roller 56 in the sheet-returning direction. Conversely, when a torque greater than or equal to the prescribed threshold is applied to the reverse roller 56, the torque limiter 59 allows the reverse roller 56 to idly rotate relative to the gear 48. Consequently, the transmission of torque from the gear 48 to the reverse roller 56 is interrupted. The torque limiter 59 may employ any type of torque-limiting means, but a coil spring type is employed as one example.

The prescribed threshold is set to a value that can enable friction between the sheets 35 and the reverse roller 56 and friction between the feed roller 630 and the reverse roller 56 to interrupt the transmission of torque from the gear 48 to the reverse roller 56. However, the prescribed threshold is set to a value such that friction between the sheets 35 interposed between the feed roller 630 and the reverse roller 56 will allow torque to be transmitted from the gear 48 to the reverse roller 56.

Accordingly, when two or more sheets 35 are present between the feed roller 630 and the reverse roller 56, the reverse roller 56 rotates in the sheet-returning direction due to the torque received from the gear 48. However, if no sheets 35 are present or only one sheet 35 is present between the feed roller 630 and the reverse roller 56, the reverse roller 56 does not receive torque from the gear 48. In this case, the reverse roller 56 follows the feed roller 630 and rotates in the sheet-feeding direction.

A driven roller 101 is disposed on a downstream side relative to the reverse roller 56 in the forward-conveying-direction (see FIG. 17). The driven roller 101 confronts the conveying roller 91, with the conveying path 20 interposed therebetween. While not illustrated in the drawings, the driven roller 101 includes a right driven roller and a left driven roller. A circumferential portion of each of the right driven roller and the left driven roller of the driven roller 101 facing in the second direction protrudes into the conveying path 20 from the bottom surface 12A of the second casing 12. By the urging force of springs (not illustrated), the right driven roller and the left driven roller of the driven roller 101 are respectively pressed against the right conveying roller 911 and the left conveying roller 912. Accordingly, the driven roller 101 follows the conveying roller 91 and rotates along with the conveying roller 91.

A second reading unit 103 is disposed on a downstream side relative to the driven roller 101 in the forward-conveying-direction (see FIG. 17). The second reading unit 103 confronts the first reading unit 93, with the conveying path 20 interposed therebetween. The second reading unit 103 is provided with a CIS (not illustrated) arranged along the left-right direction. The second reading unit 103 reads an image of a top surface of the sheet 35 conveyed along the conveying path 20.

A driven roller 102 is disposed on a downstream side relative to the second reading unit 103 in the forward-conveying-direction (see FIG. 17). The driven roller 102 confronts the conveying roller 92, with the conveying path 20 interposed therebetween. While not illustrated in the drawings, the driven roller 102 includes a right driven roller and a left driven roller. A circumferential portion of each of the right driven roller and the left driven roller of the driven roller 102 facing in the second direction protrudes into the conveying path 20 from the bottom surface 12A of the second casing 12. By the urging force of springs (not illustrated), the right driven roller and the left driven roller of the driven roller 102 are respectively pressed against the right conveying roller 921 and the left conveying roller 922. Accordingly, the driven roller 102 follows the conveying roller 92 and rotates along with the conveying roller 92.

Next, a drive mechanism 70 will be described with reference to FIG. 3. The drive mechanism 70 is disposed inside the casing 10. The drive mechanism 70 includes the conveying motor 71, a first transmission mechanism 81, a second transmission mechanism 82, a feeding motor 72, a third transmission mechanism 83, and a cylindrical part 189.

The conveying motor 71 and the first transmission mechanism 81 are disposed in a left portion of the first casing 11. The first transmission mechanism 81 includes a plurality of gears. The gears of the first transmission mechanism 81 couple the conveying motor 71 to the shaft 91A and the shaft 92A. Thus, when the conveying motor 71 is driven, the conveying roller 91 and the conveying roller 92 rotate in the sheet-feeding direction.

The second transmission mechanism 82 is disposed in a right portion of the first casing 11. The second transmission mechanism 82 includes a plurality of gears. The gears of the second transmission mechanism 82 couple the shaft 91A to the gear 48 provided on the shaft 47. Thus, when the conveying motor 71 is driven, the gear 48 rotates about the shaft 47 in the sheet-returning direction. The gear 48 transmits torque to the torque limiter 59 for rotating the torque limiter 59 in the sheet-returning direction.

The feeding motor 72 and the third transmission mechanism 83 are disposed in the right portion of the first casing 11. The third transmission mechanism 83 includes a plurality of gears. The gears of the third transmission mechanism 83 couple the feeding motor 72 to a shaft 42. The shaft 42 is supported by the first casing 11 and is rotatable about the rotation axis P. The shaft 42 can rotate both in the sheet-feeding direction and the sheet-returning direction. The gears of the third transmission mechanism 83 include a gear 43 provided on a right end portion of the shaft 42.

The cylindrical part 189 is a cylindrical body whose central axis is coincident with the rotation axis P. The cylindrical part 189 is fixed to the left end portion of the shaft 42 (see FIG. 3). As will be described later, the cylindrical part 189 is coupled to the feed roller 630. Hence, when the feeding motor 72 is driven, the shaft 42 and the cylindrical part 189 rotate together in the sheet-feeding direction, causing the feed roller 630 to rotate in the sheet-feeding direction.

In the embodiment, the circumferential speed of the feed roller 630 driven to rotate by the feeding motor 72 is configured to be slower than the circumferential speed of the conveying roller 91 driven to rotate by the conveying motor 71. The circumferential speed of the feed roller 630 is the rotating speed at circumferential regions of the right feed roller 631 and the left feed roller 632. The circumferential speed of the conveying roller 91 is the rotating speed at circumferential regions of the right conveying roller 911 and the left conveying roller 912.

Next, a rotary part 190 will be described with reference to FIGS. 3 through 6. The rotary part 190 forms a left portion of the cylindrical part 189 (see FIG.

Figure 6:
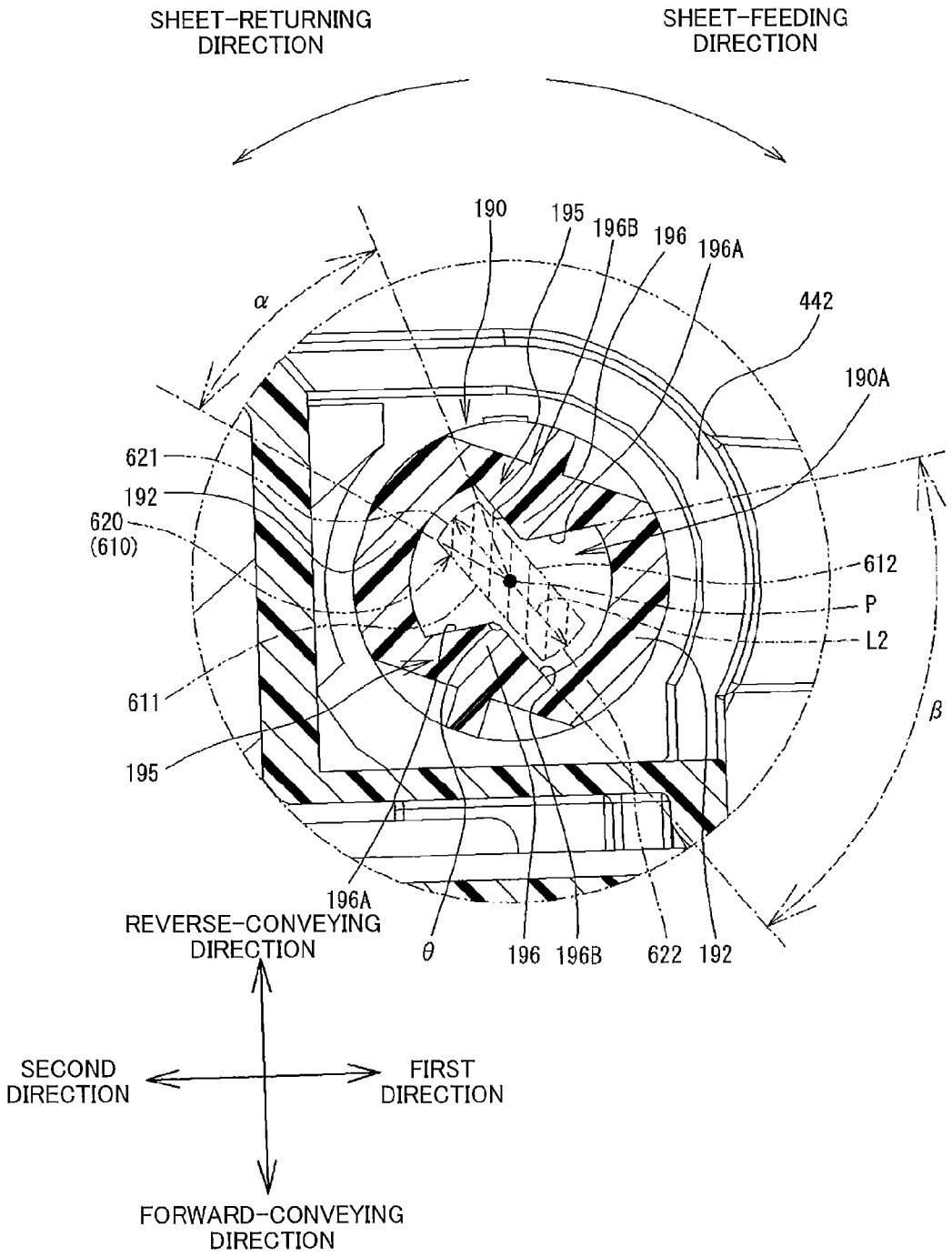
FIG. 6 is a cross-sectional view of a rotary part 190 taken along a line C-C in FIG. 5.

3). The rotary part 190 protrudes further leftward than the shaft 42. As illustrated in FIG. 6, the rotary part 190 includes a pair of curved walls 192, and a pair of connecting walls 195. The curved walls 192 and the connecting walls 195 surround a hole portion 190A formed in the interior of the rotary part 190. The curved walls 192 and the connecting walls 195 are elongated in the left-right direction. The curved walls 192 extend in the circumferential direction and are positioned on opposite sides of the rotation axis P. That is, the curved walls 192 face each other, while the rotation axis P is positioned between the curved walls 192. The connecting walls 195 extend linearly. The connecting walls 195 connect the curved walls 192.

Each of the connecting walls 195 has a first wall 196. The first walls 196 protrude inward toward the rotation axis P from circumferential ends of the curved walls 192. The first walls 196 in the embodiment have a general triangular shape in a side view. Each first wall 196 includes a first surface 196A and a second surface 196B. The first surface 196A is a flat surface that faces in the sheet-feeding direction, while the second surface 196B is a flat surface that faces in the sheet-returning direction.

Figure 4:
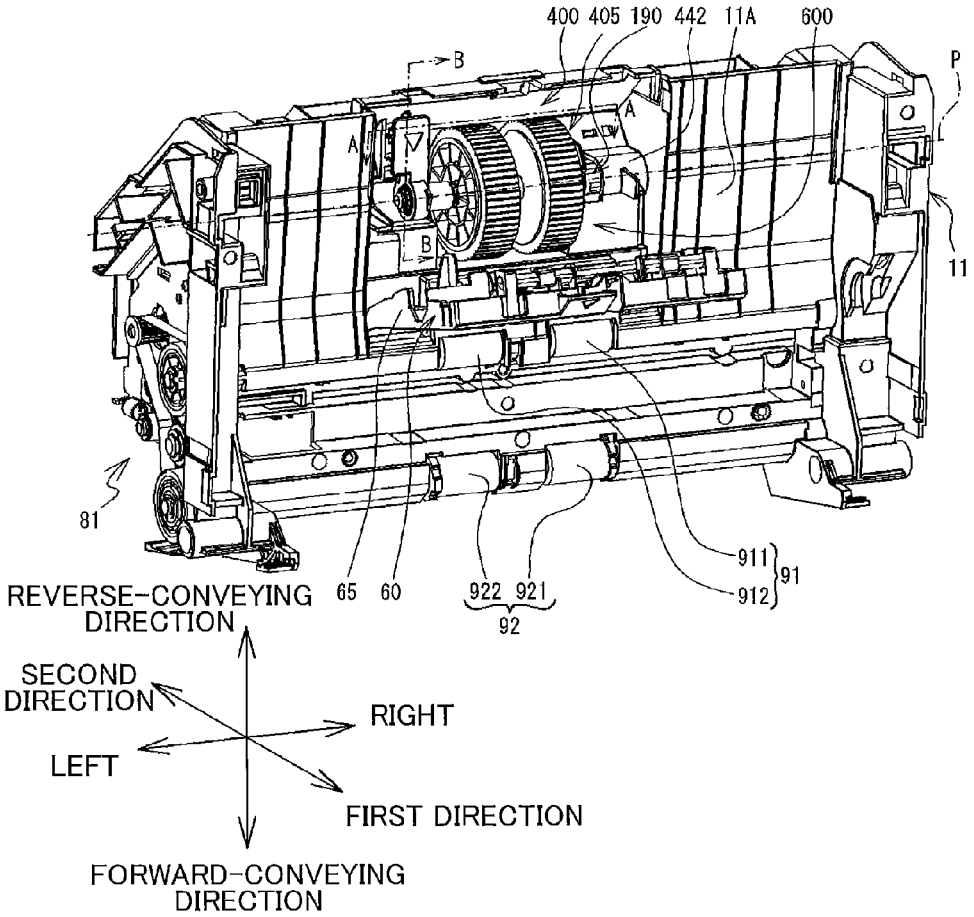
FIG. 4 is a perspective view of a first casing 11.

Next, a mounting part 400 will be described with reference to FIGS. 4 and 5. The mounting part 400 is a recessed part formed in a left-right center region of the top surface 11A of the first casing 11 and recessed downward therefrom. The mounting part 400 forms an accommodating space 405. The accommodating space 405 serves to accommodate a sheet feeding assembly 600 described later. When the sheet feeding assembly 600 is accommodated in the accommodating space 405, the rotation axis P passes through the accommodating space 405. The mounting part 400 includes a center wall 410, a right wall 440, and a left wall 470. Each of the center wall 410, the right wall 440, and the left wall 470 is a plate-shaped member constituting a wall of the mounting part 400 positioned downstream in the second direction.

The center wall 410 curves in an arc shape that arcs outward in the second direction. The right wall 440 is provided at a position rightward of the center wall 410. The right wall 440 protrudes in the first direction farther than the center wall 410. Formed in a downstream end portion of the right wall 440 in the first direction are a reception part 442 and a recessed part 444. The reception part 442 is disposed rightward of the rotary part 190 (see FIG. 4). The reception part 442 is a plate-shaped member that curves outward in the first direction. A left end portion of the shaft 42 (see FIG. 3) is inserted into a space formed inside the reception part 442.

The recessed part 444 is recessed in the second direction. The recessed part 444 is disposed leftward of the rotary part 190. A bearing 450 that is substantially C-shaped in a left-side view is mounted in the recessed part 444. The bearing 450 is an example of a first bearing. The bearing 450 has an open portion 451.

Figure 7:
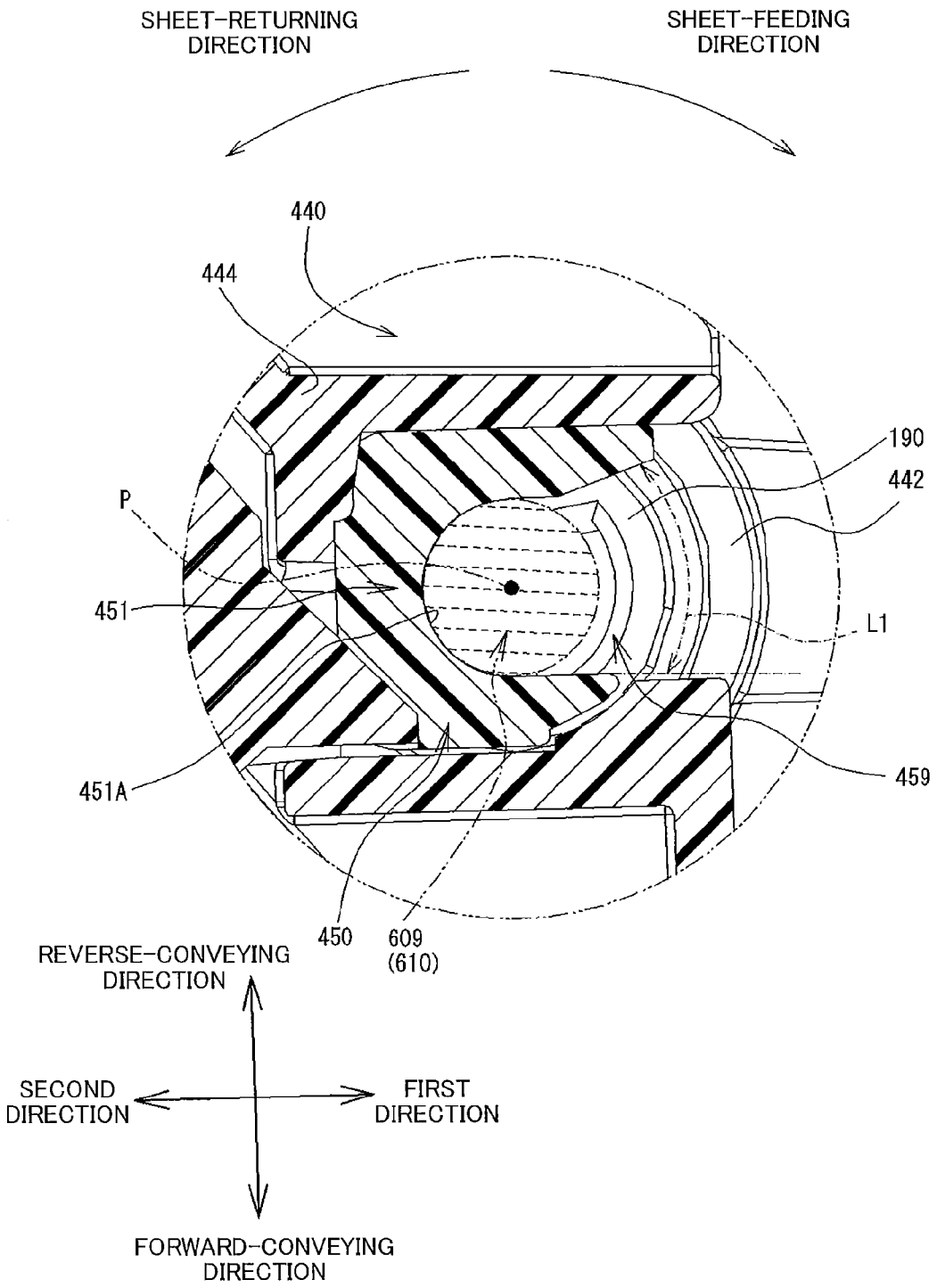
FIG. 7 is a cross-sectional view of a bearing 450 taken along a line D-D in FIG. 5.

As illustrated in FIG. 7, an insertion space 459 through which the rotation axis P passes is formed inside the open portion 451. The open portion 451 includes an inner curved surface 451A. The inner curved surface 451A is curved outward in the second direction and encircles the insertion space 459 from a downstream side in the second direction thereof. An opening is formed between downstream ends of the open portion 451 in the first direction. The opening of the open portion 451 has a dimension in the circumferential direction equivalent to a first prescribed length. Note that the first prescribed length is designated by a dimension L1 in FIG. 7. In other words, an opening having the first prescribed length L1 in the circumferential direction is formed between radial ends of the open portion 451.

Figure 5:
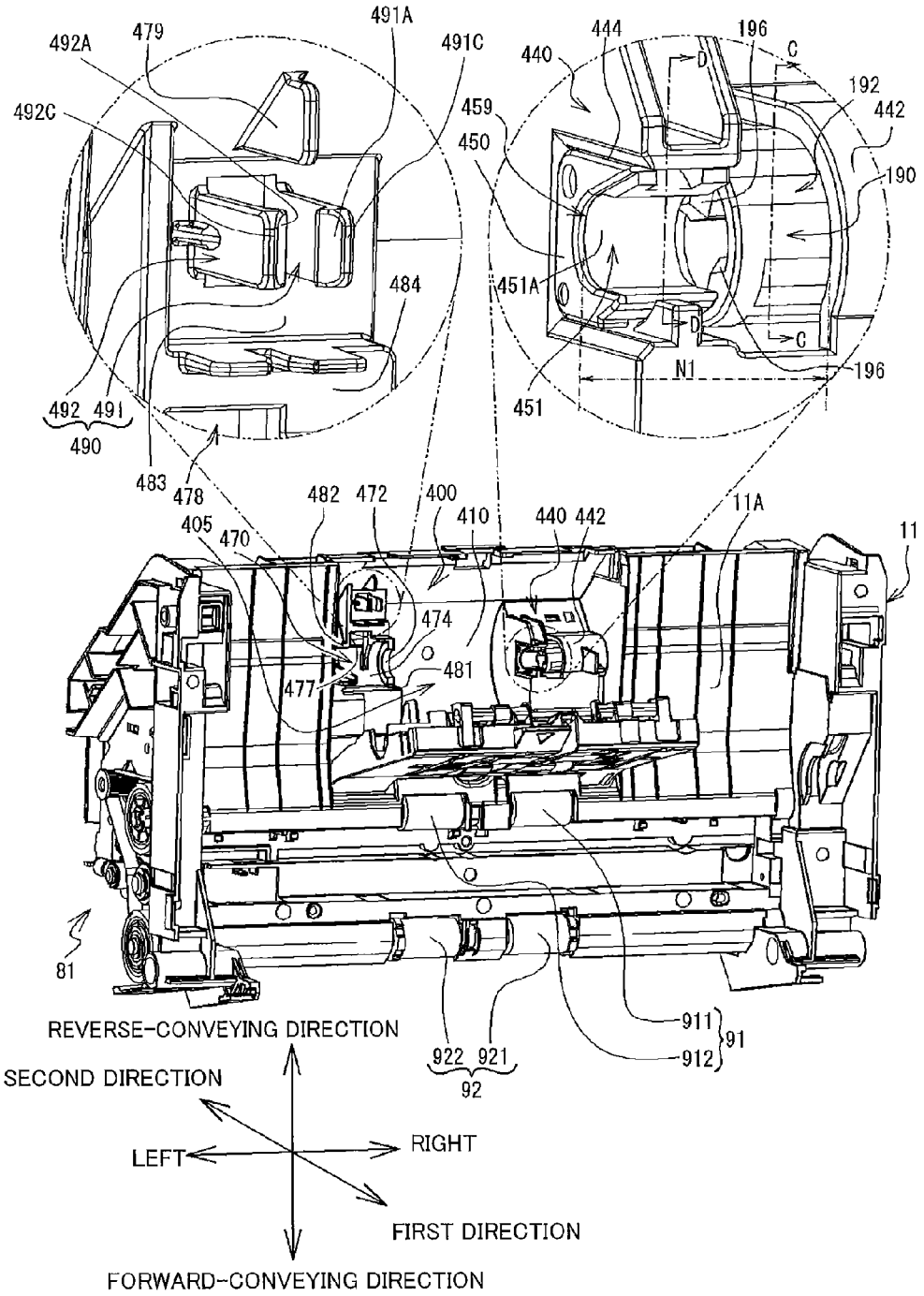
FIG. 5 is a perspective view of the first casing 11 from which a sheet feeding assembly 600 is removed.

The bearing 450 contacts the rotary part 190 from a left side thereof (see FIG. 5). In the following description, a length in the left-right direction between a left end of the bearing 450 and a right end of the rotary part 190 will be referred to as a "second prescribed length." The second prescribed length is designated a dimension N1 in FIG. 5.

Next, the left wall 470 will be described with reference to FIGS. 5 and 8. The left wall 470 is provided at a position leftward of the center wall 410. The left wall 470 protrudes in the first direction farther than the center wall 410. The left wall 470 includes a bearing part 472, an indentation wall 474, a wall 484, a first extension part 481, a second extension part 482, and a third extension part 483.

The bearing part 472 is a wall that is substantially C-shaped in a left-side view. As will be described later, the bearing part 472 contacts a right endface of a first cylindrical part 682 (described later) of a lever 680 (described later) and rotatably supports a second cylindrical part 683 (described later) of the lever 680 (see FIGS. 9, 14A and 14B). The bearing part 472 is an example of a second bearing.

The indentation wall 474 is disposed leftward of the bearing part 472. The indentation wall 474 is formed as a curved wall that is indented in the radial direction. More specifically, the indentation wall 474 extends in the left-right direction and curved outward in the second direction. A left-right dimension of the indentation wall 474 is greater than a left-right dimension of the first cylindrical part 682 of the lever 680 to allow the first cylindrical part 682 to slide in the left-right direction.

The first extension part 481 is provided on a downstream side relative to the indentation wall 474 in the forward-conveying-direction. The first extension part 481 extends in the first direction from the indentation wall 474 (see FIG. 11).

The wall 484 is provided on a downstream side relative to a right end portion of the indentation wall 474 in the reverse-conveying-direction. The wall 484 expands in the left-right direction and the conveying direction. A corner of the wall 484 formed downstream in the leftward direction and the forward-conveying direction is connected to the second extension part 482 (see FIG. 14).

An aperture 478 having a general L-shape is defined by the wall 484 and the indentation wall 474. The aperture 478 is a space that penetrates the wall 484 and the indentation wall 474 in a thickness direction thereof. In the following description, a surface defining the aperture 478 that faces rightward will be referred to as an "opposing surface 477" (see FIG. 14). The opposing surface 477 is formed by surfaces included in the wall 484 and the indentation wall 474. The opposing surface 477 confronts the aperture 478 from a left side thereof As illustrated in FIG. 5, the third extension part 483 is provided on a downstream side relative to the wall 484 in the reverse-conveying-direction. The third extension part 483 expands in the left-right direction and the conveying direction. A contact part 479 is provided on a downstream side relative to the third extension part 483 in the reverse-conveying-direction. The contact part 479 is a plate-shaped member having a substantial thickness in the left-right direction. A downstream end of the contact part 479 in the first direction extends farther in the first direction than the third extension part 483. The contact part 479 is an example of a first contact part.

Figure 8:
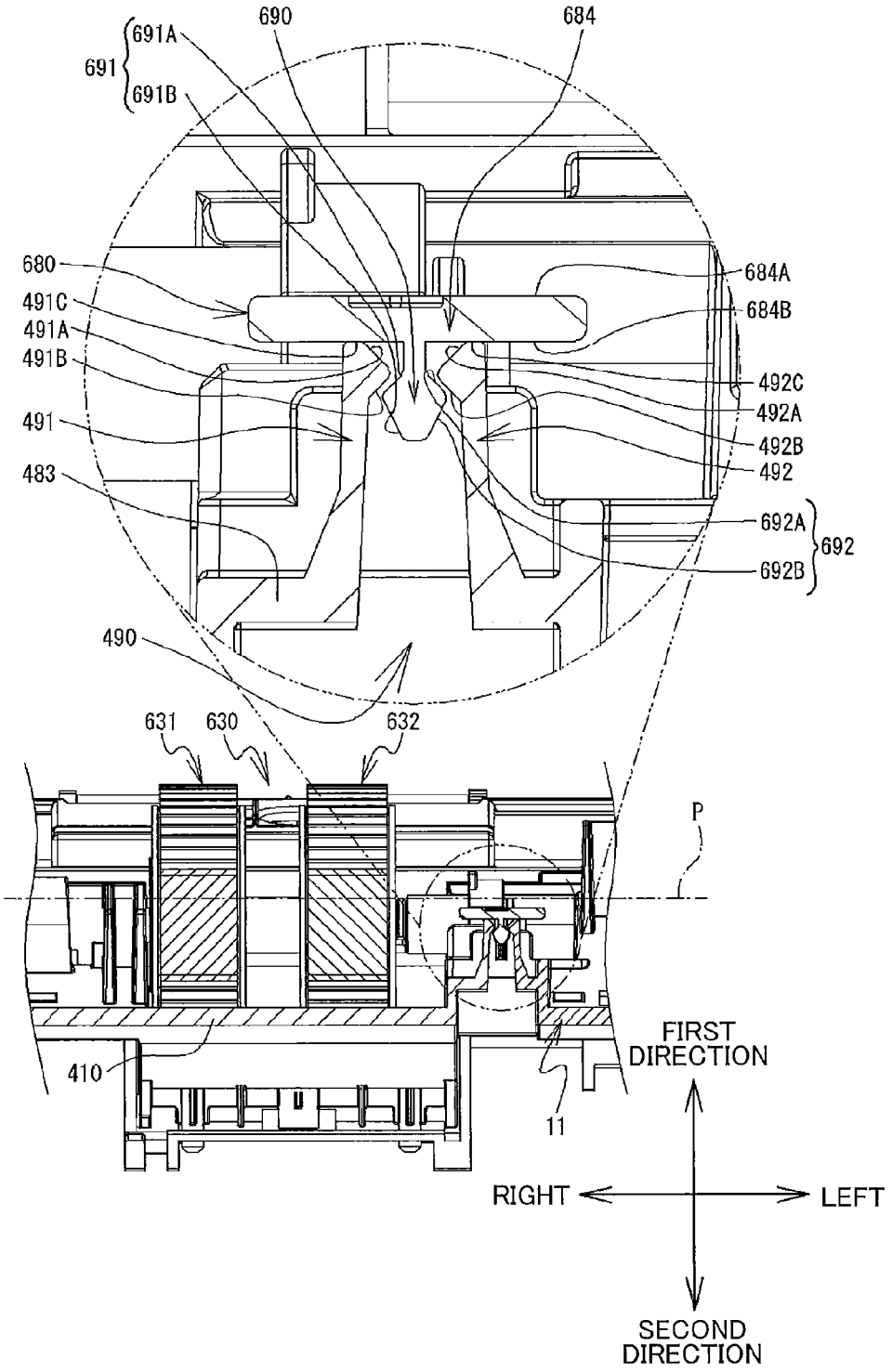
FIG. 8 is a cross-sectional view of an engaging part 490 and a lever 680 taken along a line A-A in FIG. 4.

As illustrated in FIGS. 5 and 8, an engaging part 490 is provided on the third extension part 483. The engaging part 490 engages with an engaging part 690 (described later) of the lever 680. The engaging part 490 includes a protruding part 491 and a protruding part 492. The engaging part 490 is an example of a second engaging part.

The protruding part 491 has a plate shape with a substantial thickness in the left-right direction. The protruding part 491 protrudes in the first direction from the third extension part 483. A left surface formed on a distal end of the protruding part 491 includes a sliding surface 491A, and an engaging surface 491B. The sliding surface 491A slopes leftward toward a base end of the protruding part 491 (i.e., in the second direction). The engaging surface 491B is positioned closer to the base end of the protruding part 491 than the sliding surface 491A to the base end. The engaging surface 491B slopes rightward toward the base end of the protruding part 491 (i.e., in the second direction). An endface of the protruding part 491 facing in a protruding direction of the protruding part 491 constitutes a contact surface 491C. The contact surface 491C can contact the lever 680 described later.

The protruding part 492 is disposed leftward of the protruding part 491 and is spaced apart from the protruding part 491. The shape of the protruding part 492 has left-right symmetry with the protruding part 491. A right surface formed on a distal end of the protruding part 492 includes a sliding surface 492A, and an engaging surface 492B. An endface of the protruding part 492 facing in a protruding direction of the protruding part 492 constitutes a contact surface 492C. Thus, the sliding surface 492A corresponds to the sliding surface 491A, the engaging surface 492B corresponds to the engaging surface 491B, and the contact surface 492C corresponds to the contact surface 491C.

Next, the sheet feeding assembly 600 will be described with reference to FIGS. 6, 7, 9, 10, and 11. The sheet feeding assembly 600 is detachably mounted in the mounting part 400. The sheet feeding assembly 600 includes a shaft 610. When the sheet feeding assembly 600 has been mounted in the mounting part 400, the shaft 610 is aligned in the left-right direction and engaged with the rotary part 190. The shaft 610 can rotate about the rotation axis P.

The shaft 610 includes a right end portion 609. When the sheet feeding assembly 600 has been mounted in the mounting part 400, the right end portion 609 is inserted into the hole portion 190A of the rotary part 190 (see FIG. 6) and is rotatably supported in the inner curved surface 451A formed in the bearing 450 (see FIG. 7). An insertion part 620 is provided in the right end portion 609. When the sheet feeding assembly 600 has been mounted in the mounting part 400, the insertion part 620 is inserted into the hole portion 190A of the rotary part 190 (see FIG. 6) and engaged with the rotary part 190.

As illustrated in FIG. 6, the insertion part 620 includes a first flat surface 611, a second flat surface 612, a first circumferential surface 621, and a second circumferential surface 622. The first flat surface 611 and the second flat surface 612 are an example of a prescribed surface, and also an example of a first prescribed surface and a second prescribed surface, respectively. The first circumferential surface 621 and the second circumferential surface 622 are an example of a circumferential surface. The first flat surface 611 and the second flat surface 612 are flat surfaces extending in the left-right direction and facing in the radial directions from the rotation axis P. The first flat surface 611 and the second flat surface 612 have the same shape. The first flat surface 611 and the second flat surface 612 are parallel to each other. The second flat surface 612 is disposed on the opposite side of the rotation axis P from the first flat surface 611. Note that a phrase "a surface facing in a radial direction" denotes that a normal vector to the surface has a component in the radial direction.

The first flat surface 611 and the second flat surface 612 respectively oppose the pair of first walls 196 described above. Specifically, the first flat surface 611 opposes the first surface 196A and the second surface 196B of one of the first walls 196 in the circumferential direction, while the second flat surface 612 opposes the first surface 196A and the second surface 196B of the other of the first walls 196 in the circumferential direction. As the rotary part 190 rotates in the sheet-feeding direction, the two first surfaces 196A of the rotary part 190 contact the first flat surface 611 and the second flat surface 612. Accordingly, the rotary part 190 rotates the shaft 610 in the sheet-feeding direction.

The first circumferential surface 621 and the second circumferential surface 622 extend in the circumferential direction. The first circumferential surface 621 connects a downstream end of the first flat surface 611 in the sheet-feeding-direction to a downstream end of the second flat surface 612 in the sheet-returning-direction. The second circumferential surface 622 connects a downstream end of the first flat surface 611 in the sheet-returning-direction to a downstream end of the second flat surface 612 in the sheet-feeding-direction. The second circumferential surface 622 is disposed on the opposite side of the rotation axis P from the first circumferential surface 621.

The first circumferential surface 621 and the second circumferential surface 622 form ends of the insertion part 620 in the radial direction. In the embodiment, a distance from the first circumferential surface 621 to the second circumferential surface 622 in the radial direction is a maximum outer diameter of the insertion part 620. A distance in the radial direction from the rotation axis P to a portion of the first flat surface 611 except for both ends of the first flat surface 611 extending in the axial direction is smaller than a distance in the radial direction from the rotation axis P to each of the first circumferential surface 621 and the second circumferential surface 622. Similarly, a distance in the radial direction from the rotation axis P to a portion of the second flat surface 612 except for both ends of the second flat surface 612 extending in the axial direction is smaller than the distance in the radial direction from the rotation axis P to each of the first circumferential surface 621 and the second circumferential surface 622. The maximum outer diameter of the insertion part 620 is a dimension L2 illustrated in FIG. 6. The dimension L2 is smaller than the first prescribed length L1 of the open portion 451 formed in the bearing 450 (FIG. 7).

In the embodiment, the insertion part 620 provides an angle $\alpha$, the hole portion 190A provides an angle $\beta$, and the angle $\alpha$ is smaller than the angle $\beta$, as illustrated in FIG. 6. More specifically, the angle $\alpha$ is an angle formed by lines extending from the rotation axis P to each circumferential end of the first circumferential surface 621. The angle $\beta$ is formed by sides of the hole portion 190A. More specifically, the angle $\beta$ is the smaller of the angles formed by the first surface 196A of one of the first walls 196 and the second surface 196B of the other of the first walls 196.

Further, in the embodiment, the first wall 196 provides an angle $\theta$ which is approximately 120 degrees. More specifically, the angle $\theta$ is the smaller of the angles formed by the first surface 196A and the second surface 196B of either one of the first walls 196.

Figure 9:
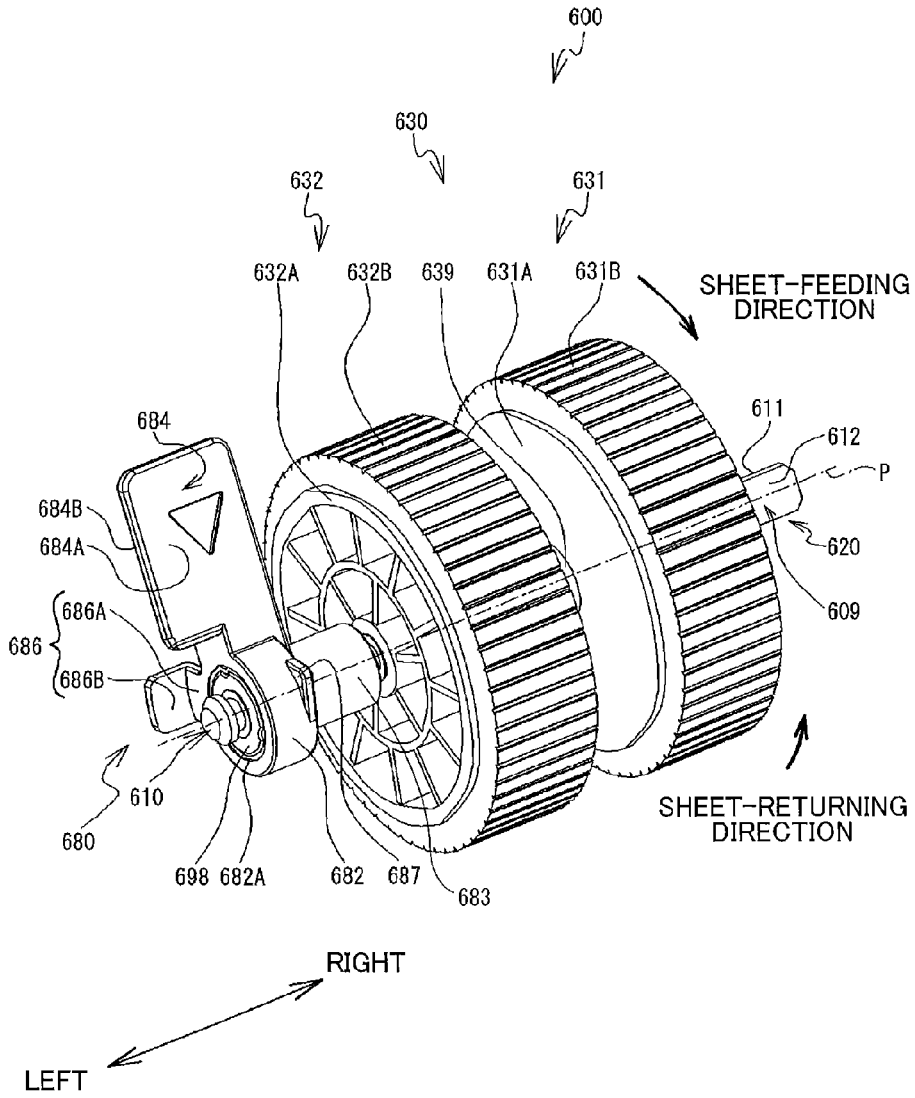
FIG. 9 is a perspective view of the sheet feeding assembly 600.
Figure 10:
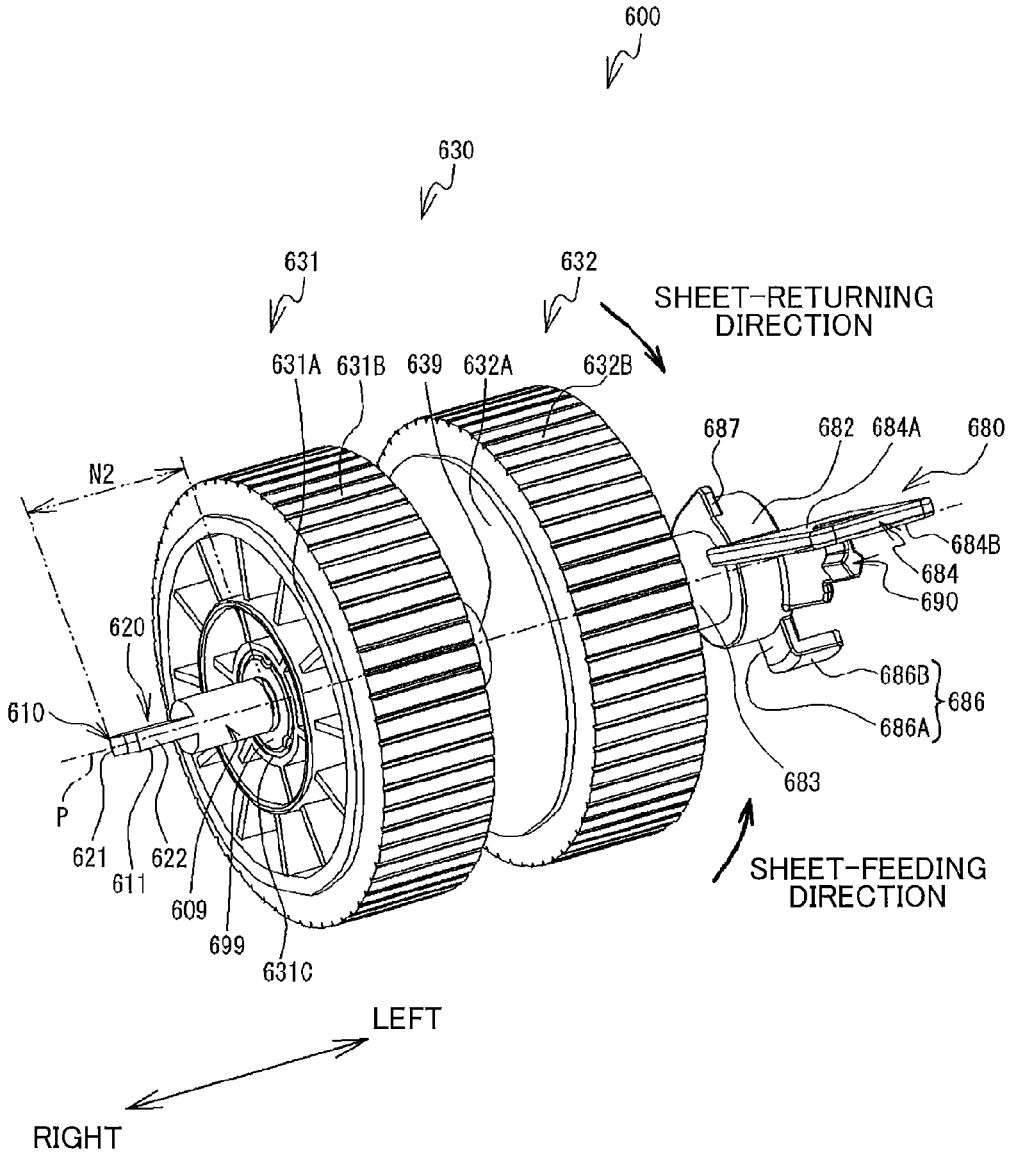
FIG. 10 is a perspective view of the sheet feeding assembly 600.

The sheet feeding assembly 600 also includes the feed roller 630. The feed roller 630 is supported on the shaft 610 at a position leftward of the insertion part 620. A circumferential portion of the feed roller 630 facing in the first direction protrudes into the conveying path 20 from the top surface 11A of the first casing 11. As illustrated in FIGS. 9 and 10, the feed roller 630 includes the right feed roller 631, a cylindrical part 639, and the left feed roller 632.

The right feed roller 631 includes a right coupling part 631A. The right coupling part 631A has a columnar shape whose axis is aligned with the rotation axis P. An insertion hole 631C through which the shaft 610 is inserted is formed in a center region of the right coupling part 631A in the radial direction. Hereinafter, a segment of the shaft 610 positioned rightward of the right coupling part 631A will be referred to as a "first axial segment", and a length of the first axial segment will be referred to as an "axial length." The first axial segment includes the right end portion 609. The axial length is designated by dimension N2 in FIG. 10. The axial length N2 is equivalent to the second prescribed length N1 (FIG. 5). In other words, the right feed roller 631 is arranged on the shaft 610 such that the axial length N2 of the first axial segment is equivalent to the second prescribed length N1.

A right contact part 631B is provided on an outer circumferential surface of the right coupling part 631A in the circumferential direction. The right contact part 631B is a rubber forming an outer circumferential portion of the right feed roller 631. The right contact part 631B protrudes into the conveying path 20 from the top surface 11A of the first casing 11 (see FIG. 2). The right contact part 631B contacts the right reverse roller 561.

The cylindrical part 639 has a cylindrical shape whose axis is aligned with the rotation axis P. The cylindrical part 639 extends leftward from the right coupling part 631A. The shaft 610 is inserted through the inside of the cylindrical part 639. In the embodiment, the cylindrical part 639 is formed integrally with the right coupling part 631A.

The left feed roller 632 includes a left coupling part 632A. The left coupling part 632A has a columnar shape whose axis is aligned with the rotation axis P. The shaft 610 is inserted through a center region of the left coupling part 632A in the radial direction. In the embodiment, the left coupling part 632A is formed integrally with the cylindrical part 639. A left contact part 632B is provided on an outer circumferential surface of the left coupling part 632A in the circumferential direction. The left contact part 632B is a rubber forming an outer circumferential portion of the left feed roller 632. The left contact part 632B protrudes into the conveying path 20 from the top surface 11A of the first casing 11 (see FIG. 2). The left contact part 632B contacts the left reverse roller 562.

The feed roller 630 is supported on the shaft 610 via a one-way clutch 699, as illustrate in FIG. 10. The one-way clutch 699 is inserted into the insertion hole 631C of the right feed roller 631. In other words, the one-way clutch 699 is interposed between the right feed roller 631 and the shaft 610 in the radial direction. The one-way clutch 699 allows the right coupling part 631A to idly rotate relative to the shaft 610 in the sheet-feeding direction, while restricting the right coupling part 631A from idly rotating relative to the shaft 610 in the sheet-returning direction. In other words, the feed roller 630 can idly rotate relative to the shaft 610 in the sheet-feeding direction but cannot idly rotate relative to the shaft 610 in the sheet-returning direction.

Here, the feed roller 630 may idly rotate relative to the shaft 610 in the sheet-feeding direction when a first torque is applied to the feed roller 630. The first torque rotates the feed roller 630 in the sheet-feeding direction at a faster rotational speed (i.e., angular speed) than the shaft 610. Therefore, the feed roller 630 rotates together with the shaft 610 in the sheet-feeding direction when the shaft 610 rotates in the sheet-feeding direction while the first torque is not applied to the feed roller 630. In the embodiment, the rotational speed of the conveying roller 91 is faster than the rotational speed of the shaft 610. Therefore, when a sheet 35 is being conveyed while nipped between the conveying roller 91 and the driven roller 101 and between the feed roller 630 and the reverse roller 56, the feed roller 630 receives the first torque via the sheet 35. Consequently, the feed roller 630 idly rotates relative to the shaft 610 in the sheet-feeding direction.

As illustrated in FIGS. 9 and 10, the sheet feeding assembly 600 includes the lever 680. The lever 680 is pivotally movably supported on the shaft 610 at a position leftward of the feed roller 630. Thus, the lever 680 is disposed opposite to the right end portion 609 with respect to the feed roller 630. The lever 680 includes the first cylindrical part 682, the second cylindrical part 683, a grip part 684, a contact part 687, a locking arm 686, and the engaging part 690.

The first cylindrical part 682 has a cylindrical shape whose axis is aligned with the rotation axis P. A cylindrical hole 682A is formed in the first cylindrical part 682. A one-way clutch 698 is inserted into the cylindrical hole 682A of the first cylindrical part 682. The first cylindrical part 682 is supported on the shaft 610 via the one-way clutch 698. The one-way clutch 698 allows the lever 680 to idly rotate relative to the shaft 610 in the sheet-returning direction while restricting the lever 680 from idly rotating relative to the shaft 610 in the sheet-feeding direction.

The second cylindrical part 683 extends rightward from a right end of the first cylindrical part 682 toward the left feed roller 632. The second cylindrical part 683 has a cylindrical shape whose axis is aligned with the rotation axis P. The second cylindrical part 683 covers an outer circumference of the shaft 610. The second cylindrical part 683 has an outer diameter smaller than that of the first cylindrical part 682. The second cylindrical part 683 is supported by the bearing part 472. In other words, the shaft 610 is supported on the bearing part 472 via the second cylindrical part 683 between the left feed roller 632 and the first cylindrical part 682.

The grip part 684 is a plate-shaped member having a substantial thickness in the circumferential direction. The grip part 684 extends outward in the radial direction from the first cylindrical part 682. A user can grip the grip part 684. A surface of the grip part 684 facing in the sheet-feeding direction constitutes a first contact surface 684A as an example of a first portion. A surface of the grip part 684 on the opposite side from the first contact surface 684A (i.e., a surface facing in the sheet-returning direction) constitutes a second contact surface 684B. The first contact surface 684A can contact a cover 60 (described later, see FIG. 4). The second contact surface 684B can contact the contact part 479 of the left wall 470 (see FIG. 5) and the contact surfaces 491C and 492C of the engaging part 490 (see FIG. 8). In the following description, a pivot position of the lever 680 when the second contact surface 684B contacts the contact part 479 and the contact surfaces 491C and 492C will be referred to as a "first pivot position." FIGS. 4, 8, 11, and others illustrate the lever 680 in the first pivot position. When the lever 680 is in the first pivot position, the contact part 479 and the contact surfaces 491C and 492C restrict the lever 680 from pivotally moving in the sheet-returning direction.

The contact part 687 is disposed on a downstream side relative to the grip part 684 in the sheet-feeding direction. The contact part 687 protrudes outward in the radial direction from the first cylindrical part 682. The contact part 687 can contact the first extension part 481 (see FIG. 5) from a downstream side in the sheet-returning direction thereof The contact part 687 is an example of a second contact part. In the following description, a pivot position of the lever 680 when the contact part 687 contacts the first extension part 481 of the left wall 470 will be referred to as a "second pivot position." FIG. 12 and others illustrate the lever 680 in the second pivot position.

The lever 680 is restricted from pivotally moving farther in the sheet-feeding direction from the second pivot position by the contact between the contact part 687 and the first extension part 481. While the insertion part 620 of the shaft 610 is inserted into the rotary part 190, the lever 680 can pivotally move between the first pivot position and the second pivot position. In the following description, a region through which the first contact surface 684A passes when the lever 680 pivotally moves between the first pivot position and the second pivot position will be referred to as a "first region 684C" (see FIG. 13). In other words, the first region 684C is a trajectory or moving range of the first contact surface 684A when the lever 680 pivotally moves between the first pivot position and the second pivot position.

The locking arm 686 is disposed on the first cylindrical part 682 at a position downstream relative to the grip part 684 in the sheet-returning direction. The locking arm 686 includes a first extension part 686A, and a second extension part 686B. The first extension part 686A extends in the radial direction from the first cylindrical part 682. The second extension part 686B protrudes leftward from a distal edge in the radial direction of the first extension part 686A. In the embodiment, the second extension part 686B extends in the circumferential direction.

Figure 11:
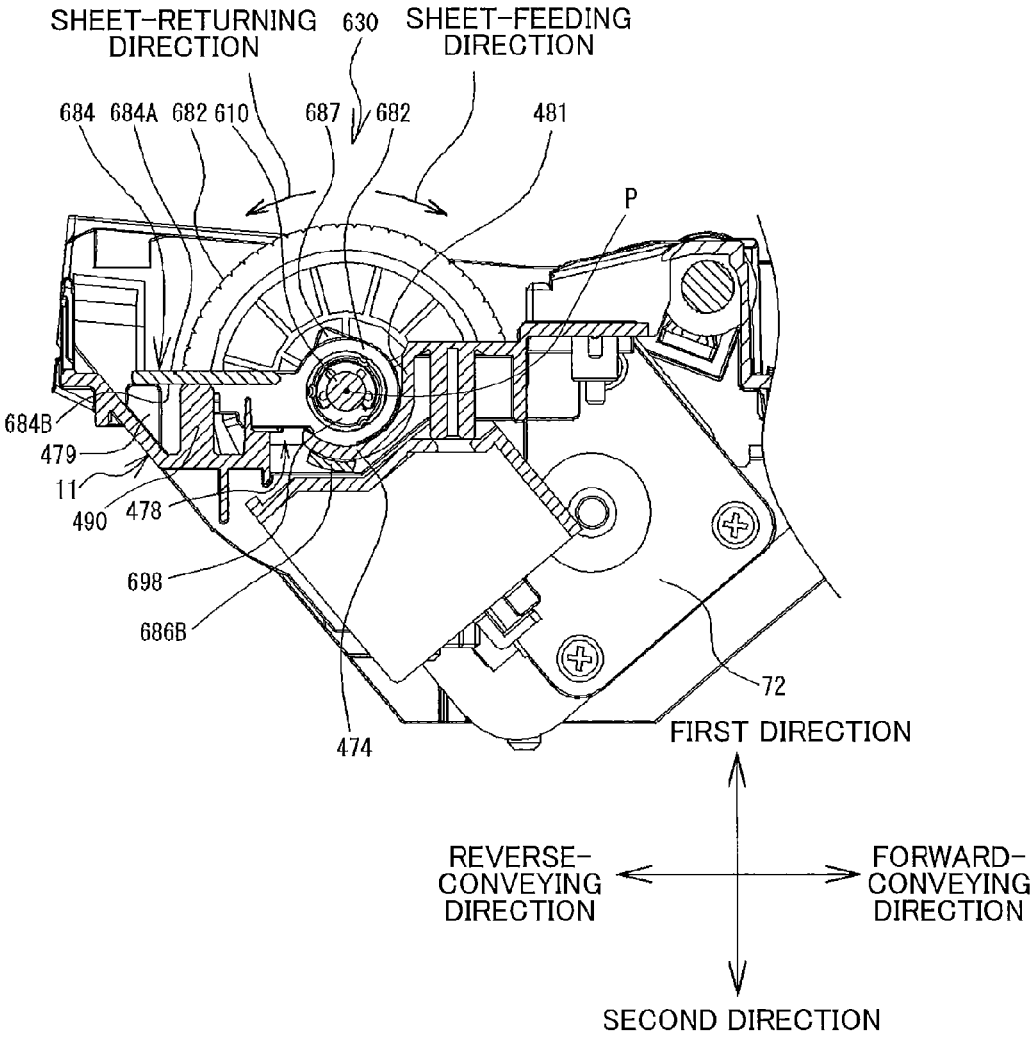
FIG. 11 is a cross-sectional view of the lever 680 taken along a line B-B in FIG. 4.

When the lever 680 is in the first pivot position, the locking arm 686 is inserted inside the first casing 11 (see FIG. 11). In this state, the second extension part 686B confronts the indentation wall 474 from a downstream side in the second direction thereof. In other words, the indentation wall 474 is positioned between the second extension part 686B and the rotation axis P in the radial direction. This arrangement restricts the lever 680 in the first pivot position from moving in the first direction.

Figure 14A:
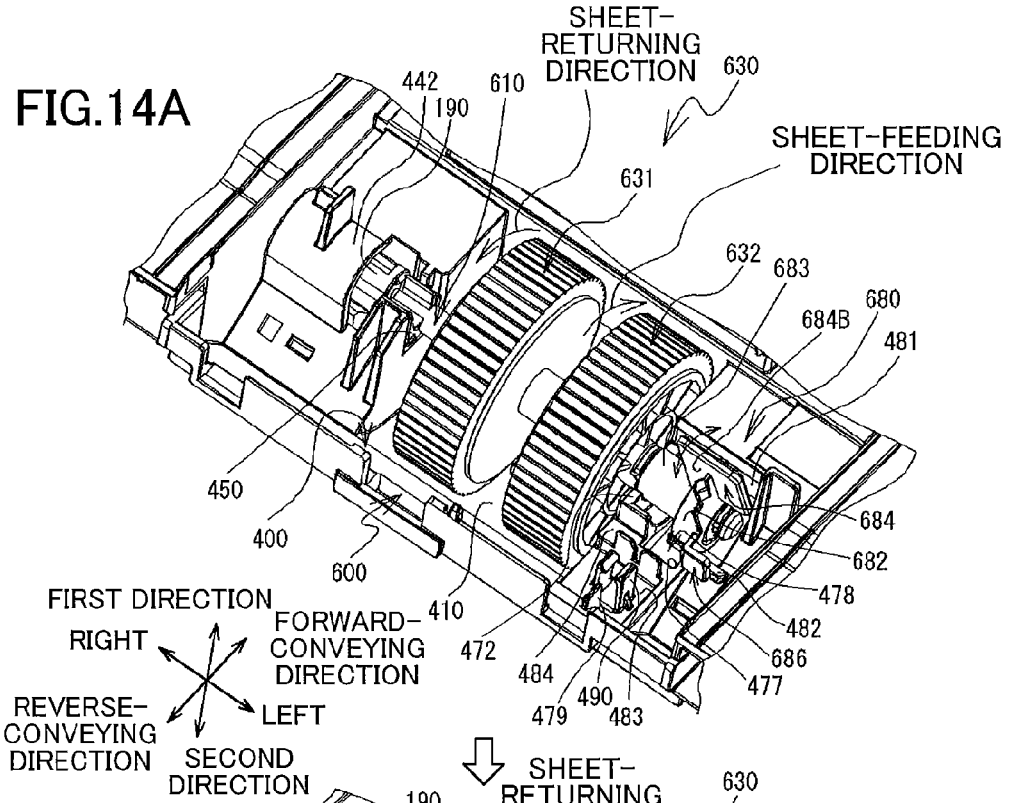
FIGS. 14A and 14B are explanatory views how the sheet feeding assembly 600 is mounted in a mounting part 400.
Figure 14B:
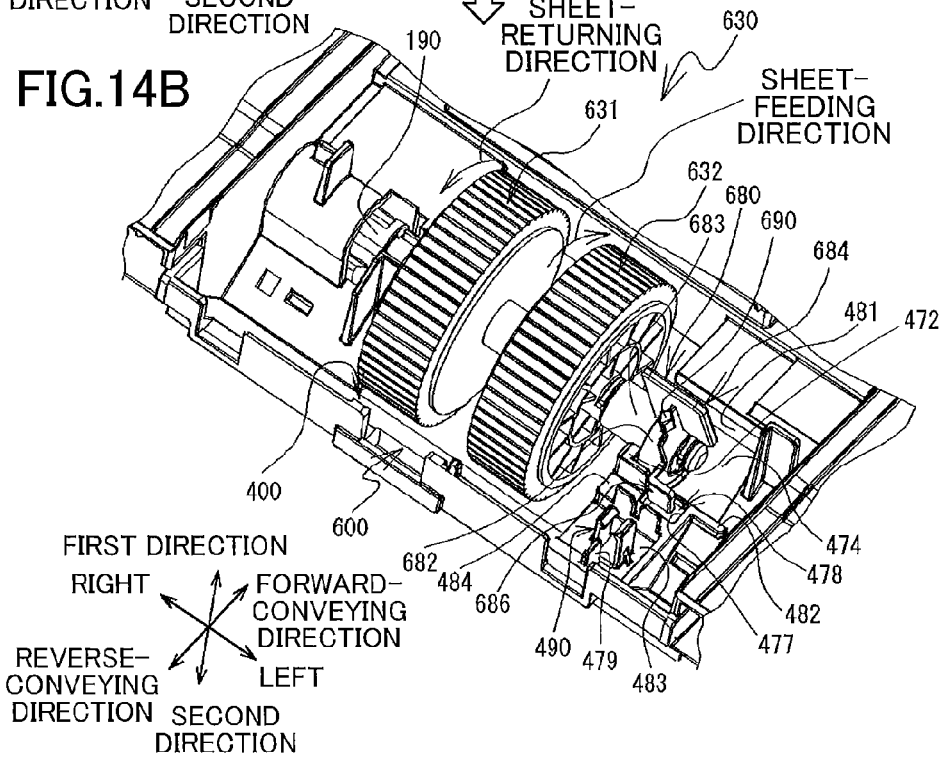

When the sheet feeding assembly 600 is mounted in the mounting part 400, the shaft 610 is in a mounted position (see FIG. 14B). The mounted position is a position of the shaft 610 in the left-right direction when the insertion part 620 is inserted into the rotary part 190. While the shaft 610 is in the mounted position, the locking arm 686 is positioned rightward of the opposing surface 477 of the left wall 470, and the locking arm 686 is adjacent to the opposing surface 477 in the left-right direction. In other words, when the shaft 610 is in the mounted position, the opposing surface 477 of the left wall 470 is adjacent to the locking arm 686. Here, the expression "the opposing surface 477 is adjacent to the locking arm 686" denotes that the shortest distance in the left-right direction from the opposing surface 477 to the locking arm 686 is shorter than the left-right dimension of the first wall 196 (see FIG. 5). The left-right dimension of the first wall 196 is no greater than a distance that the shaft 610 moves in the left-right direction between its mounted position and a retracted position (described later, see FIG. 14A). The expression "the opposing surface 477 is adjacent to the locking arm 686" includes s state in which the opposing surface 477 is in contact with the locking arm 686. When the lever 680 pivotally moves from the first pivot position to the second pivot position while the shaft 610 is in the mounted position, the locking arm 686 can move out of the first casing 11 through the aperture 478.

As illustrated in FIGS. 8 and 10, the engaging part 690 protrudes in the sheet-returning direction from the grip part 684 (and specifically, the second contact surface 684B). The engaging part 690 is an example of a first engaging part. The engaging part 690 has a right surface 691 formed with an engaging surface 691A, and a sliding surface 691B. The engaging surface 691A slopes rightward in the sheet-returning direction. The engaging surface 691A can engage with the engaging surface 491B. The sliding surface 691B is disposed on a downstream side relative to the engaging surface 691A in the sheet-returning-direction. The sliding surface 691B slopes leftward in the sheet-returning direction. The sliding surface 691B can slide over the sliding surface 491A.

The engaging part 690 also has a left surface 692 that has left-right symmetry with the right surface 691. The left surface 692 is formed with an engaging surface 692A, and a sliding surface 692B. The engaging surface 692A corresponds to the engaging surface 691A, while the sliding surface 692B corresponds to the sliding surface 691B. That is, the engaging surface 692A can engage with the engaging surface 492B, and the sliding surface 692B can slide over the sliding surface 492A.

When the lever 680 is in the first pivot position, the engaging part 690 engages with the engaging part 490. Specifically, when the lever 680 is in the first pivot position, the engaging surface 691A engages with the engaging surface 491B, and the engaging surface 692A engages with the engaging surface 492B. This arrangement maintains the lever 680 in the first pivot position.

Figure 12:
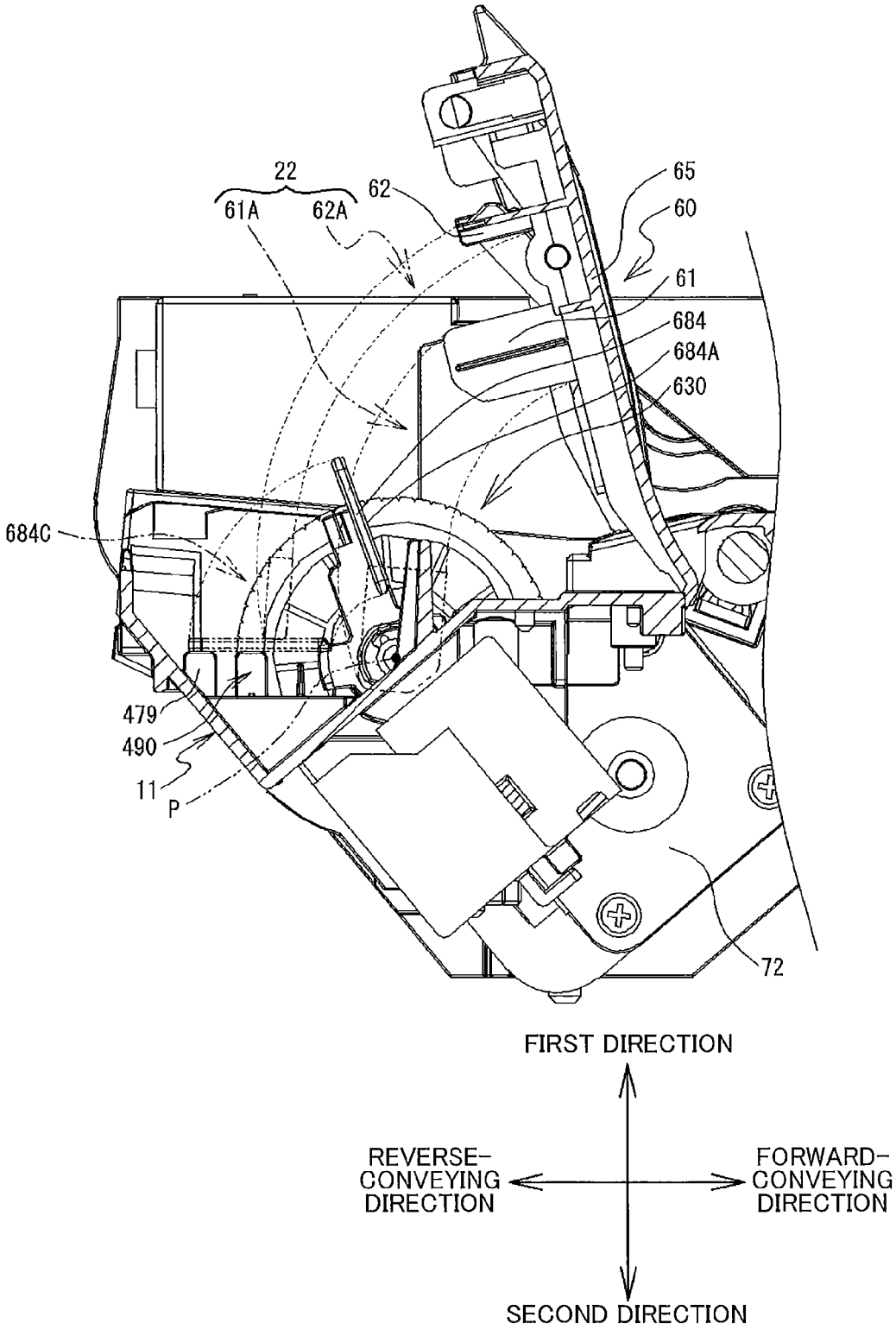
FIG. 12 is a left side cross-sectional view of a cover 60.

Next, a cover 60 will be described with reference to FIGS. 2, 4, and 12. The cover 60 is disposed over the mounting part 400 provided in the first casing 11. The cover 60 includes a base part 65. The base part 65 is a substantially rectangular, plate-shaped member. One end portion of the base part 65 is pivotally movably supported by a shaft part (not illustrated). The shaft part is provided at a downstream end portion of the mounting part 400 in the forwarding-conveying-direction. The cover 60 can pivotally move about the shaft part between an open position (see FIG. 12) and a closed position (see FIG. 2). When the cover 60 is in the open position, the accommodating space 405 is exposed on a side facing in the first direction. In other words, the cover 60 exposes the sheet feeding assembly 600 on the first-direction side when in the open position. When in the closed position, the cover 60 closes the accommodating space 405. In other words, the cover 60 covers the sheet feeding assembly 600 from a downstream side in the first direction thereof when in the closed position. In the following description, a pivotally moving direction of the cover 60 when the cover 60 pivotally moves from the open position to the closed position will be referred to as a "closing direction."

An aperture 63 (see FIG. 2) is formed in the base part 65. The aperture 63 penetrates a center region of the cover 60 in a thickness direction thereof. When the cover 60 is in the closed position, the aperture 63 exposes the right contact part 631B and the left contact part 632B of the feed roller 630 to the conveying path 20.

The cover 60 further includes a first protrusion 61, and a second protrusion 62. The first protrusion 61 and the second protrusion 62 are an example of a protrusion. Both of the first protrusion 61 and the second protrusion 62 are plate-shaped members that protrude in the closing direction from the base part 65. The second protrusion 62 is separated farther from the shaft part (not illustrated) than is the first protrusion 61. When the shaft 610 is in the mounted position, the first protrusion 61 and the second protrusion 62 are positioned on a downstream side relative to the grip part 684 in the sheet-feeding direction and have the same left-right position as a left edge of the grip part 684.

In the following description, a regions through which the first protrusion 61 and the second protrusion 62 pass when the cover 60 pivotally moves from the open position to the closed position will be respectively referred to as a "first traversing region 61A" and a "second traversing region 62A" (see FIG. 13). In other words, the first traversing region 61A is a trajectory or moving range of the first protrusion 61 when the cover 60 pivotally moves from the open position to the closed position, and the second traversing region 62A is a trajectory or moving range of the second protrusion 62 when the cover 60 pivotally moves from the open position to the closed position. Further, the first traversing region 61A and the second traversing region 62A will be collectively referred to as a "second region 22" (see FIG. 13). In other words, the second region 22 is also a trajectory or moving range of the first protrusion 61 and the second protrusion 62 when the cover 60 pivotally moves from the open position to the closed position.

Figure 13:
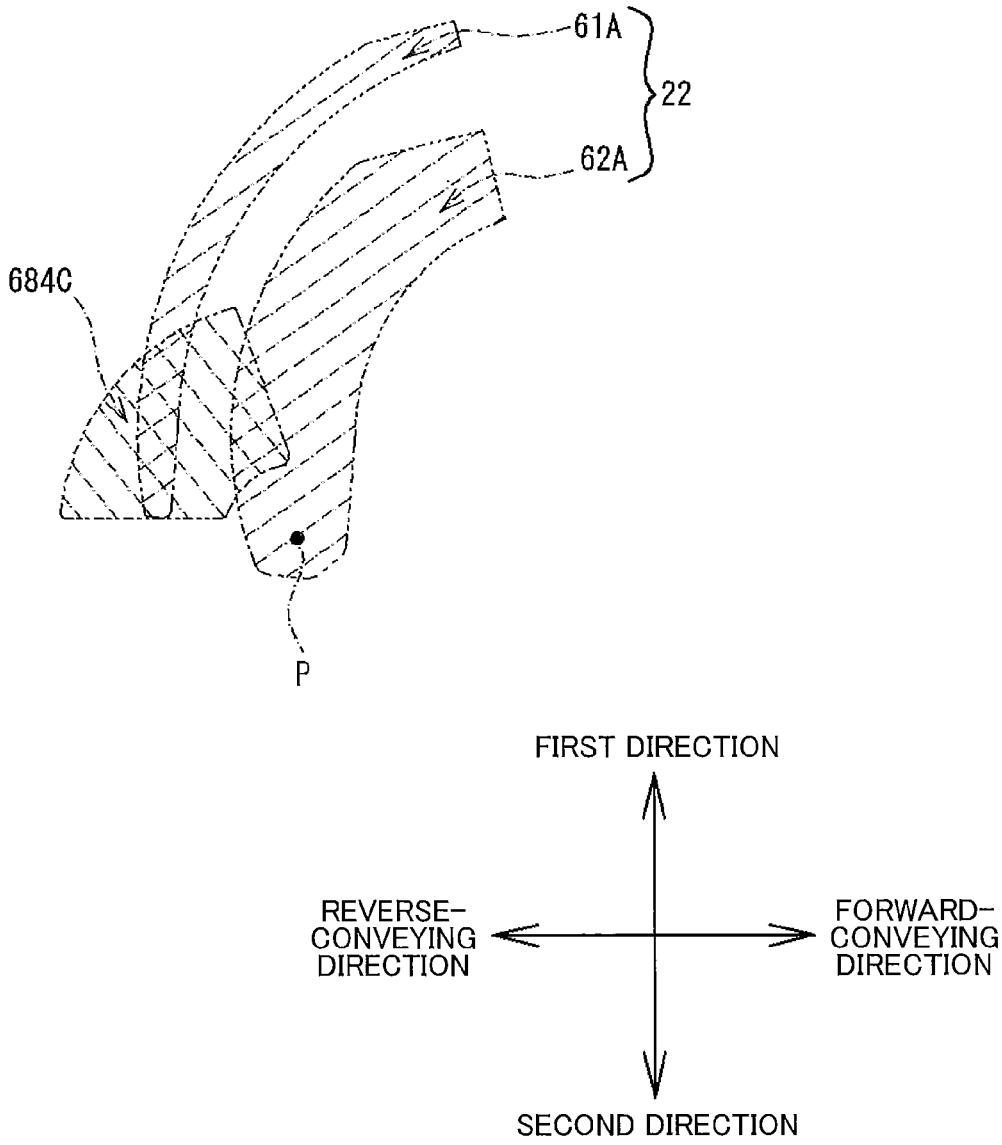
FIG. 13 is a left side view of a first region 684C and a second region 22.

As illustrated in FIG. 13, at least part of the first region 684C falls in the second region 22 throughout the entire circumferential-direction range of the first region 684C. That is, the second region 22 overlaps the first region 684C in its entire range in the circumferential direction. Accordingly, when the cover 60 pivotally moves from the open position to the closed position, the first protrusion 61 and the second protrusion 62 can move the lever 680 to its first pivot position.

Figure 15A:
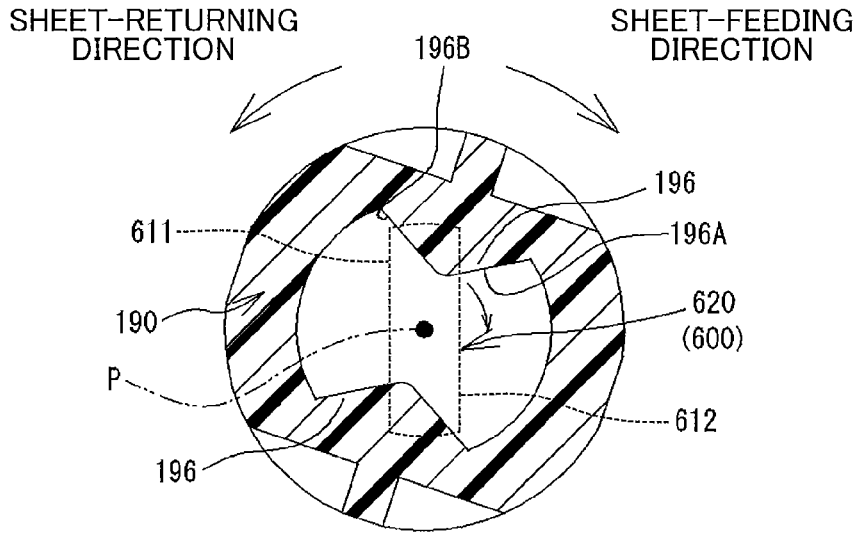
FIGS. 15A and 15B are explanatory views how a rotated position of a shaft 610 is adjusted to a rotated position for insertion.
Figure 15B:
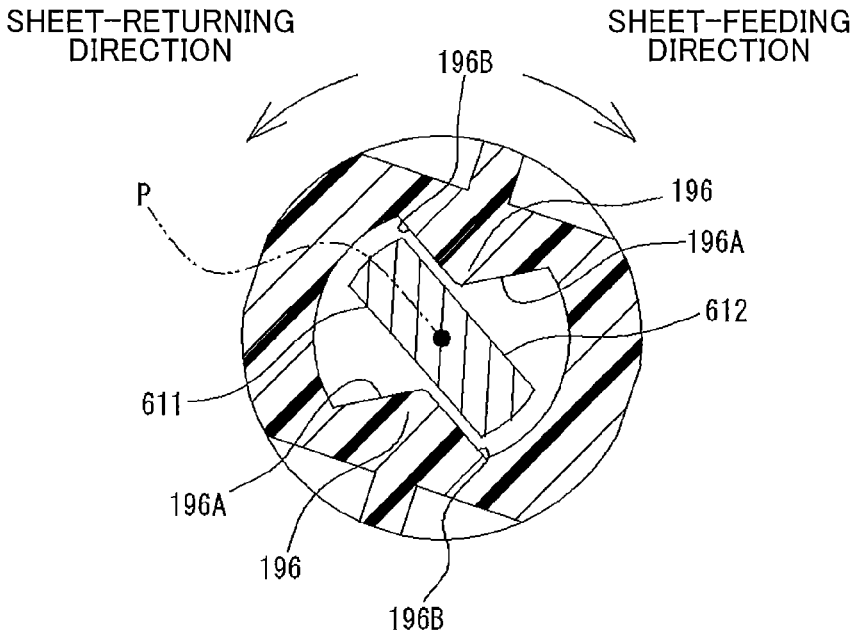

Next, a method of mounting the sheet feeding assembly 600 in the mounting part 400 will be described with reference to FIGS. 5, 14, 15, and 16. This description will assume that the sheet feeding assembly 600 has been removed from the mounting part 400 and the cover 60 is in the open position (see FIG. 5). FIGS. 15A and 15B are cross-sectional views of the rotary part 190 and the shaft 610 taken along a plane and in a direction indicated by arrows C-C in FIG. 5.

First, a user places the sheet feeding assembly 600 in the accommodating space 405 of the mounting part 400 (see FIG. 14A). At this time, the user places the shaft 610 in the retracted position. The retracted position is a position of the shaft 610 in the left-right direction when the insertion part 620 is rotatably supported by the bearing 450. The retracted position is also a position further leftward than the mounted position. In other ward, when the shaft 610 is in the retracted position, a left end of the shaft 610 is positioned further leftward than that when the shaft 610 is in the mounted position. When in the retracted position, the shaft 610 is positioned leftward of the first walls 196 of the rotary part 190 (see FIG. 15A). That is, a distance between a left end of the indentation wall 474 and a left end of the rotary part 190 is greater than a length of the shaft 610 in the axial direction. The first prescribed length L1 described above for the open portion 451 formed in the bearing 450 is greater than the maximum outer diameter of the insertion part 620 (see FIG. 7). Therefore, when the shaft 610 is disposed in the retracted position, the user can easily insert the right end portion 609 of the shaft 610 into the insertion space 459 of the bearing 450 from a downstream side in the first direction thereof, regardless of the rotated position of the right end portion 609.

When the shaft 610 is in the retracted position, the first cylindrical part 682 of the lever 680 is at the same left-right position as the second extension part 482 and the right endface of the first cylindrical part 682 is separated leftward from the bearing part 472. When the shaft 610 is in the retracted position, the first cylindrical part 682 is positioned on a downstream side relative to the second extension part 482 in the forward-conveying direction. While the shaft 610 is placed in the retracted position, the user moves the grip part 684 in the circumferential direction to a position downstream relative to the contact part 479 in the sheet-feeding direction and downstream relative to the first extension part 481 in the sheet-returning direction.

When the shaft 610 is in the retracted position, the lever 680 can be pivotally moved between the second pivot position and an intermediate pivot position (FIG. 14A). The intermediate pivot position is an example of a third pivot position. The intermediate pivot position is a pivot position of the lever 680 when the locking arm 686 contacts the second extension part 482 from a downstream side in the sheet-feeding direction thereof. The intermediate pivot position is a position between the first pivot position and the second pivot position. While in the intermediate pivot position, the lever 680 is restricted from pivotally moving in the sheet-returning direction by the second extension part 482. In the embodiment, the lever 680 pivotally moves approximately 10 degrees from the second pivot position to the intermediate pivot position.

When the shaft 610 is in the retracted position and the rotated position of the shaft 610 differs from a rotated position for insertion (see FIG. 15A), the first walls 196 of the rotary part 190 restrict the sheet feeding assembly 600 from moving rightward. The rotated position for insertion is a rotated position of the shaft 610 that allows the insertion part 620 to be inserted into the hole portion 190A of the rotary part 190. In other words, the rotated position for insertion is a rotated position of the shaft 610 at which the insertion part 620 is at a different position in the circumferential direction from the first walls 196.

The user can determine that the rotated position of the shaft 610 differs from the rotated position for insertion by verifying that the sheet feeding assembly 600 disposed in the accommodating space 405 cannot slide farther rightward even when urged rightward. In this case, the user grips the grip part 684 and pivotally moves the lever 680 between the second pivot position and the intermediate pivot position.

When the user pivotally moves the lever 680 toward the second pivot position in the sheet-feeding direction, the shaft 610 rotates in the sheet-feeding direction together with the lever 680. As a result, the shaft 610 not in the rotated position for insertion rotates in the sheet-feeding direction. However, if the user pivotally moves the lever 680 toward the intermediate pivot position in the sheet-returning direction, the lever 680 idly pivotally moves relative to the shaft 610 in the sheet-returning direction, and thus, the shaft 610 does not rotate. The user continuously rotates the shaft 610 in the sheet-feeding direction by alternately pivotally moving the lever 680 in the sheet-feeding direction and the sheet-returning direction. In this way, the user adjusts the rotated position of the shaft 610 to the rotated position for insertion (see FIG. 15B).

Next, the user slides the sheet feeding assembly 600 rightward by urging the sheet feeding assembly 600 rightward through the grip part 684 (see FIG. 14B). As a result, the shaft 610 slides rightward into the mounted position. The first cylindrical part 682 slides rightward along the indentation wall 474, and the second cylindrical part 683 slides rightward while supported in the bearing part 472. Then, the user releases the grip part 684. At this time, the lever 680 is in the second pivot position, for example. The right endface of the first cylindrical part 682 is adjacent to (in contact with, for example) a left end of the bearing part 472. The bearing part 472 supports a left end portion of the second cylindrical part 683.

Figure 16A:
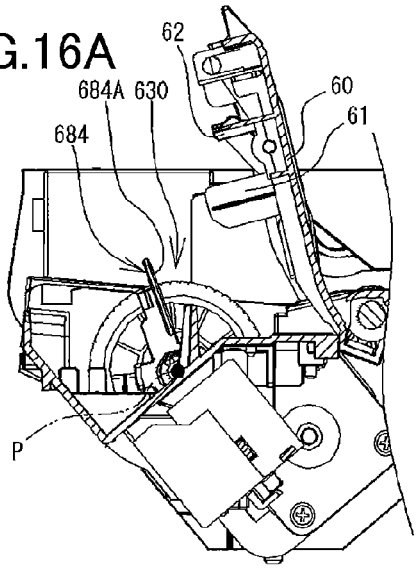
FIGS. 16A through 16D are explanatory views how the cover 60 is pivotally moved from an open position to a closed position.
Figure 16B:
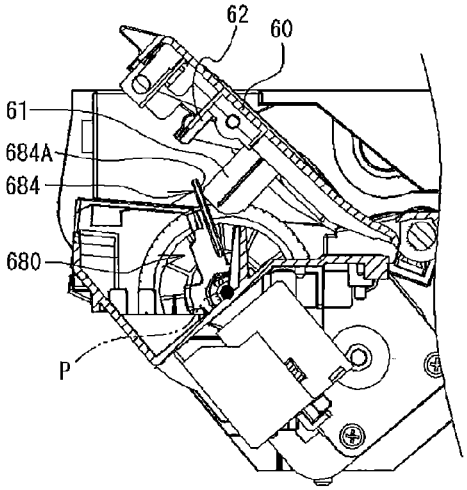
Figure 16C:
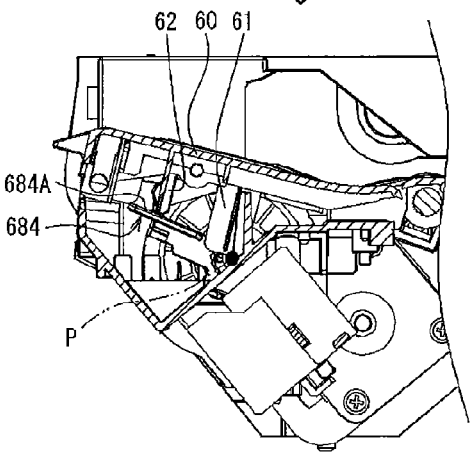
Figure 16D:
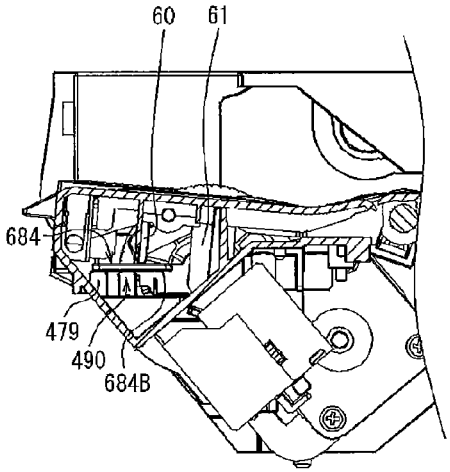
Figure 16D:
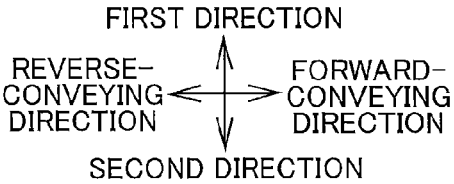

As illustrated in FIG. 16, the user pivotally moves the cover 60 in the closing direction from the open position (see FIGS. 16A and 16B). As the user pivotally moves the cover 60 in the closing direction, the first protrusion 61 contacts the first contact surface 684A of the grip part 684 before the second protrusion 62 contacts the first contact surface 684A, and urges the lever 680 in the sheet-returning direction. As the user continues to pivotally move the cover 60, the lever 680 pivotally moves in the sheet-returning direction from the second pivot position so that the locking arm 686 passes through the aperture 478.

The pivotally moving first protrusion 61 slides along the first contact surface 684A toward the rotation axis P. When the first protrusion 61 separates from the first contact surface 684A, the second protrusion 62 contacts the first contact surface 684A in place of the first protrusion 61 (see FIG. 16C). As the user continues pivotally moving the cover 60 in the closing direction, the second protrusion 62 continues to pivotally move the lever 680 in the sheet-returning direction (see FIGS. 16C and 16D).

While not illustrated in the drawings, the engaging part 690 advances between the distal ends of the protruding parts 491 and 492 while the second protrusion 62 pivotally moves the lever 680 in the sheet-returning direction. At this time, the sliding surfaces 691B and 692B of the engaging part 690 (see FIG. 8) respectively slide against the sliding surfaces 491A and 492A of the engaging part 490. Consequently, the protruding parts 491 and 492 flex so that their distal ends separate from each other in the left-right direction. When the user has pivotally moved the cover 60 all the way to the closed position, the lever 680 has pivotally moved to the first pivot position and the engaging part 690 has engaged with the engaging part 490. In this state, the sheet feeding assembly 600 is mounted in the mounting part 400.

Figure 18:
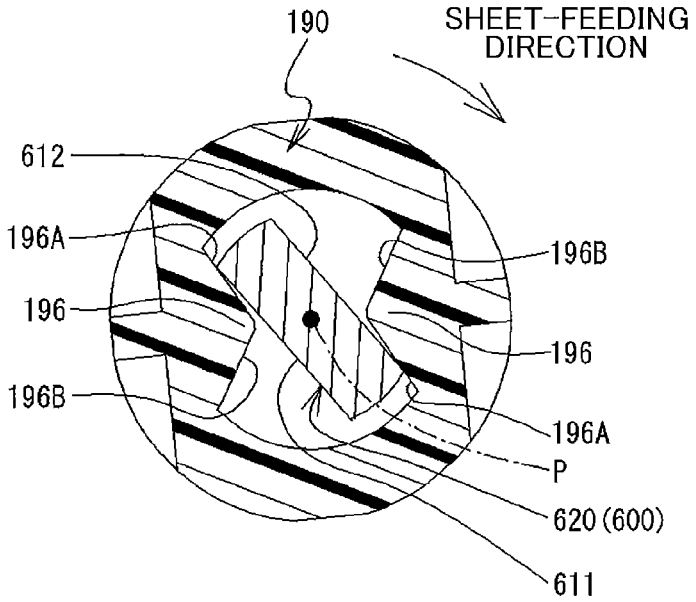
FIG. 18 is a left side cross-sectional view of the rotary part 190 for rotating the shaft 610.

Next, an overview of a reading operation performed on the image reading apparatus 1 will be described with reference to FIGS. 17A, 17B, and 18. FIGS. 17A and 17B schematically illustrate a cross-sectional view of the image reading apparatus 1 taken along a plane passing an approximate left-right center of the image reading apparatus 1 and viewed from a right side thereof. In the following description, a position at which the feed roller 630 contacts the reverse roller 56 will be referred to as a "first nip position," a position at which the conveying roller 91 contacts the driven roller 101 will be referred to as a "second nip position," and a position at which the conveying roller 92 contacts the driven roller 102 will be referred to as a "third nip position."

The user stacks a plurality of sheets 35 on the sheet feeding tray 16. When the sheets 35 are stacked on the sheet feeding tray 16, downstream edges of the sheets 35 in the forward-conveying direction are positioned on a downstream side relative to the first nip position in the reverse-conveying direction. The image reading apparatus 1 drives the feeding motor 72 and the conveying motor 71 to begin the reading operation. As the feeding motor 72 is driven, the shaft 42 and the rotary part 190 rotate together in the sheet-feeding direction. By rotating the rotary part 190, the pair of first walls 196 each contacts the insertion part 620 (see FIG. 18). Specifically, the first surface 196A of one of the first walls 196 contacts the first flat surface 611, and the first surface 196A of the other of the first walls 196 contacts the second flat surface 612. Through this contact, the rotary part 190 rotates the shaft 610 and the feed roller 630 in the sheet-feeding direction. Here, the one-way clutch 698 maintains the lever 680 in a stationary state at the first pivot position.

Further, as the conveying motor 71 is driven, the conveying rollers 91 and 92 are rotated in the sheet-feeding direction, and torque for urging rotation in the sheet-returning direction is applied to the torque limiter 59. The torque limiter 59 interrupts transmission of torque to the reverse roller 56 for rotating the reverse roller 56 in the sheet-returning direction until the downstream edges of the sheets 35 in the forward-conveying direction arrive at the first nip position. Thus, the reverse roller 56 follows the feed roller 630 and rotates in the sheet-feeding direction.

Once the sheets 35 reach the first nip position, the reverse roller 56 receives torque from the torque limiter 59 and begins rotating in the sheet-returning direction. With the sheets 35 interposed between the reverse roller 56 and the feed roller 630, the feed roller 630 separates a first sheet 35A from the other sheets 35 and feeds the first sheet 35A in the forward-conveying direction. The first sheet 35A is the bottommost single sheet 35 among the sheets 35 stacked on the sheet feeding tray 16.

A downstream edge in the forward-conveying direction of the first sheet 35A fed by the feed roller 630 is conveyed through the second nip position and further downstream in the forward-conveying direction (see FIG. 17A). The circumferential speed of the conveying roller 91 is faster than that of the feed roller 630. Hence, the first torque is applied to the feed roller 630 when the first sheet 35A reaches the second nip position. The one-way clutch 699 allows the feed roller 630 to idly rotate relative to the shaft 42. As a result, the feed roller 630 rotates with approximately the same circumferential speed as the conveying roller 91, enabling the image reading apparatus 1 to suppress an excessive load being applied to the first sheet 35A.

The first reading unit 93 and the second reading unit 103 read images from the first sheet 35A as the first sheet 35A passes over the first reading unit 93 and the second reading unit 103. Subsequently, the downstream edge of the first sheet 35A in the forward-conveying direction is conveyed through the third nip position to the discharge opening 10B.

When a downstream edge of the first sheet 35A in the reverse-conveying direction passes through the first nip position (see FIG. 17B), the drive of the feeding motor 72 is temporarily halted in order to set a suitable gap in the conveying direction between the first sheet 35A and the sheet 35 fed after the first sheet 35A. When the downstream edge of the first sheet 35A in the reverse-conveying direction passes through the first nip position, the feed roller 630 instantaneously contacts the reverse roller 56, whereby the reverse roller 56 applies torque to the feed roller 630 for rotating the feed roller 630 in the sheet-returning direction. However, the feed roller 630 is still unlikely to rotate in the sheet-returning direction since the one-way clutch 699 restricts the feed roller 630 from idly rotating relative to the shaft 610 in the sheet-returning direction. In addition, the one-way clutch 698 restricts the shaft 42 from idly rotating relative to the lever 680 in the sheet-returning direction, while the contact part 479 and the contact surfaces 491C and 492C restrict the lever 680 in the first pivot position from rotating in the sheet-returning direction. Therefore, the shaft 610 is restricted from idly rotating in the sheet-returning direction an amount equivalent to backlash in the plurality of gears provided in the second transmission mechanism 82, even if torque is applied to the feed roller 630 for rotating the feed roller 630 in the sheet-returning direction. Here, backlash in the gears of the second transmission mechanism 82 is play that allows movement when the drive of the feeding motor 72 is temporarily halted.

The image reading apparatus 1 completes the reading operation for the first sheet 35A by discharging the first sheet 35A into the discharge tray 18 through the discharge opening 10B. Next, the image reading apparatus 1 drives the feeding motor 72 to begin feeding the succeeding sheet 35. The image reading apparatus 1 repeats the same reading operation described above until there are no more sheets 35 in the sheet-feeding tray 16.

When mounting the sheet feeding assembly 600 in the mounting part 400 as described above, the user inserts the right end portion 609 of the shaft 610 into the insertion space 459 formed in the bearing 450 from a downstream side in the first direction thereof. The opening formed in the downstream end of the open portion 451 in the first direction has a dimension in the circumferential direction equivalent to the first prescribed length L1, which is greater than the maximum outer diameter of the right end portion 609 (see FIG. 7). Thus, the user can easily insert the shaft 610 into the insertion space 459. Further, by gripping the grip part 684 and alternately pivoting the lever 680 in the sheet-feeding direction and the sheet-returning direction, the user can adjust the rotated position of the shaft 610 to the rotated position for insertion. Accordingly, the structure of the image reading apparatus 1 according to the embodiment facilitates the user in mounting the sheet feeding assembly 600 in the mounting part 400.

Moreover, the rotated position for insertion is not limited to one. That is, there is a plurality of rotated positions for insertion. Specifically, the shaft 610 illustrated in FIG. 6 is in a rotated position for insertion, and the position of the shaft 610 after being rotated 180 degrees about the rotation axis P from the rotated position in FIG. 6 is also a rotated position for insertion. In other words, the shaft 610 is in the rotated position for insertion both when the first flat surface 611 opposes the first surface 196A of one of the first walls 196 and when the first flat surface 611 opposes the first surface 196A of the other of the first walls 196. Accordingly, the user can easily adjust the rotated position of the shaft 610 to the rotated position for insertion while the shaft 610 is in the retracted position. Further, since the angle $\alpha$ of the insertion part 620 is smaller than the angle $\beta$ formed by the sides of the hole portion 190A, rotated positions for insertion exist across a continuous range in the circumferential direction, making it even easier for the user to adjust the rotated position of the shaft 610 to the rotated position for insertion.

The one-way clutch 699 restricts the feed roller 630 from idly rotating relative to the shaft 610 in the sheet-returning direction. Thus, the one-way clutch 699 restricts play between the feed roller 630 and the shaft 610. Therefore, the feed roller 630 is unlikely to rotate in the sheet-returning direction along with the reverse roller 56, even when the downstream edge in the reverse-conveying direction of the sheet 35 being conveyed passes through the first nip position. Accordingly, the image reading apparatus 1 enables the feed roller 630 to stably feed the sheets 35.

When the lever 680 is in the first pivot position, the locking arm 686 has advanced inside the first casing 11 and the indentation wall 474 confronts the second extension part 686B from a downstream side in the first direction thereof. With this configuration, the sheet feeding assembly 600 is unlikely to become detached from the mounting part 400, even when urged in the first direction. Accordingly, the image reading apparatus 1 can restrain the sheet feeding assembly 600 from coming out of the mounting part 400.

When the lever 680 is in the first pivot position, the engaging part 690 provided at the lever 680 is engaged with the engaging part 490 provided at the mounting part 400. Hence, the image reading apparatus 1 can further restrain the sheet feeding assembly 600 from coming out of the mounting part 400.

When the shaft 610 is in the retracted position, the locking arm 686 is positioned leftward of the aperture 478, thereby preventing the lever 680 from pivotally moving toward the first pivot position. Hence, the image reading apparatus 1 can restrict the user from pivotally moving the locking arm 686 to the first pivot position prior to sliding the shaft 610 into the mounted position. Accordingly, the image reading apparatus 1 can ensure that the user mounts the sheet feeding assembly 600 in the mounting part 400 according to the proper procedure.

At least part of the first region 684C falls in the second region 22 along the entire circumferential range of the first region 684C. Therefore, the first protrusion 61 and second protrusion 62 can pivotally move the lever 680 to its first pivot position when the user pivotally moves the cover 60 to the closed position. Accordingly, the image reading apparatus 1 improves the operability of mounting the sheet feeding assembly 600 in the mounting part 400.

When the lever 680 is in the second pivot position, the contact part 687 of the lever 680 contacts the first extension part 481 of the mounting part 400. This contact restricts the lever 680 from pivotally moving in the sheet-feeding direction from the second pivot position. Further, the first protrusion 61 and the second protrusion 62 contact the first contact surface 684A of the grip part 684 from a downstream side in the sheet-feeding direction thereof when the lever 680 is in the second pivot position. Hence, when the cover 60 is pivotally moved from the open position to the closed position, the lever 680 can reliably be pivotally moved from the second pivot position to the first pivot position. Thus, the image reading apparatus 1 improves the operability for mounting the sheet feeding assembly 600 in the mounting part 400.

The lever 680 is provided on the left side relative to the feed roller 630, which is the opposite side from the right end portion 609. Further, the second cylindrical part 683 of the lever 680 is rotatably supported on the bearing part 472 of the mounting part 400. Therefore, a segment of the shaft 610 on the left side relative to the feed roller 630 has two functions: a function for supporting the lever 680, and a function for rotatably engaging the bearing part 472. Therefore, the shaft 610 can be made shorter than in a configuration in which the lever 680 is provided on the right side relative to the feed roller 630. Accordingly, the image reading apparatus 1 with this configuration can achieve a more compact sheet feeding assembly 600. Further, the axial length N2 of first axial segment is equivalent to the second prescribed length N1. Therefore, the image reading apparatus 1 can achieve an even more compact sheet feeding assembly 600 than a configuration in which the axial length is greater than the second prescribed length.

Various modifications to the above-described embodiment are conceivable.

For example, a problem with a different aspect (a separate problem) exists in a structure whose feed roller is mounted by passing a shaft of the feed roller through an opening formed in a bearing, such as that of a conventional sheet feeder. If the sheet feeder were to incur an impact in a fall, for example, and the force of impact acts on the feed roller in a direction for ejecting the feed roller from the bearing (i.e., the first direction), the feed roller may fall out of the bearing with the structure of the conventional sheet feeder. This separate problem becomes more apparent when cutouts are formed in a portion of the shaft or when the size of the opening in the bearing is greater than the radial dimension (maximum outer diameter) of the shaft, as in the embodiment described above. Further, the same problem is likely to occur with a bearing that holds one end of the shaft while abutting the one end of the shaft in the axial direction (a thrust bearing, for example), even if an opening is not formed in the bearing. This separate problem is resolved in the embodiment described above by the locking arm 686.

Specifically, with the indentation wall 474 opposing the second extension part 686B from a downstream side in the first direction thereof, and in particular since the second extension part 686B is farther from the rotation axis P in the radial direction than the indentation wall 474, the sheet feeding assembly 600 is unlikely to come out of the mounting part 400, even if the sheet feeding assembly 600 were urged in the first direction. Hence, the second extension part 686B resolves the separate problem independent of the formation of the bearing 450 (the size of the open portion 451, for example) or the presence of the insertion part 620.

The one-way clutch 699 may be disposed between the gear 43 and the shaft 42 rather than between the right feed roller 631 and the shaft 610. In this case, the feed roller 630 is configured to be integrally rotatable with the shaft 610.

The insertion part 620 of the shaft 610 need not be provided with the second flat surface 612. In this case, a single outer circumferential surface extends in the circumferential direction between both circumferential edges of the first flat surface 611. Alternatively, the first flat surface 611 and the second flat surface 612 may be shaped differently from each other. Further, in place of the first circumferential surface 621 and the second circumferential surface 622, the insertion part 620 may be provided with a third flat surface and a fourth flat surface (both not illustrated). In this case, the third and fourth flat surfaces are parallel to each other and disposed on opposite sides of the rotation axis P, for example. The third and fourth flat surfaces connect respective circumferential edges of the first flat surface 611 and the second flat surface 612.

In place of the first flat surface 611 and the second flat surface 612, the insertion part 620 of the shaft 610 may be provided with two curved surfaces, for example. The curved surfaces may curve inward toward the rotation axis P or outward away from the rotation axis P, for example. The two curved surfaces may have any shape, provided that the rotary part 190 can rotate the shaft 610 in the sheet-feeding direction when the two curved surfaces respectively contact the two first surfaces 196A of the rotary part 190.

The second extension part 686B may protrude leftward from an approximate center region in the radial direction of the first extension part 686A rather than the distal edge in the radial direction of the first extension part 686A. Further, the lever 680 may be disposed on a right side relative to the feed roller 630, i.e., the same side on which the insertion part 620 is provided.

The rotary part 190 may be provided with a single first wall 196 rather than the pair of first walls 196. In this case, the insertion part 620 can be inserted into the hole portion 190A of the rotary part 190 when rotated to a position at which one of the first flat surface 611 and the second flat surface 612 faces the first wall 196 in the circumferential direction.

Figure 19:
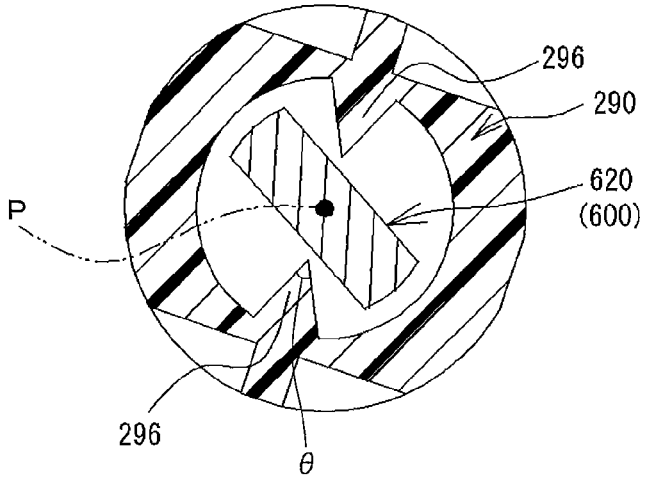
FIG. 19 is a left side cross-sectional view of a rotary part 290.

The angle θ of the first wall 196 may be set smaller than the angle over which the lever 680 can pivotally move when the shaft 610 is in the retracted position (e.g., 10 degrees; hereinafter referred to as a "first angle"). In a variation of the rotary part 190 illustrated in FIG. 19 , a rotary part 290 is provided with a pair of first walls 296 in place of the pair of first walls 196. An angle θ of each first wall 296 is approximately 50 degrees, for example. This arrangement employs the first angle of 60 degrees rather than 10 degrees (not illustrated). When the user pivots the grip part 684 back and forth one time (e.g. from the second pivot position to the intermediate position in the sheet-returning direction, and then, from the intermediate position to the second pivot position in the sheet-feeding direction) while the shaft 610 is in the retracted position, the shaft 610 can rotate over an angle equivalent to the first angle. In other words, when in the retracted position, the shaft 610 can rotate in the circumferential direction an angle equivalent to 60 degrees, which is a larger prescribed angle than the angle θ of the first wall 296 (50 degrees). Thus, when the shaft 610 is in the retracted position, the user can adjust the rotated position of the shaft 610 to the rotated position for insertion more easily.

While the description has been made in detail with reference to the embodiments thereof, it would be apparent to those skilled in the art that many modifications and variations may be made therein without departing from the scope of the disclosure.

What is claimed is:

1. A sheet feeder comprising:

a sheet feeding assembly comprising:

a shaft configured to rotate about a rotation axis extending in an axial direction, the shaft having one end portion and another end portion in the axial direction, the one end portion having an insertion part, the insertion part including a prescribed surface and a circumferential surface, the prescribed surface crossing in a radial direction of the shaft, the prescribed surface having one end extending in the axial direction and another end extending in the axial direction, the circumferential surface extending in a circumferential direction of the shaft from the one end of the prescribed surface and the another end of the prescribed surface, a distance in the radial direction from the rotation axis to a portion of the prescribed surface except for the one end of the prescribed surface and the another end of the prescribed surface being smaller than a distance in the radial direction from the rotation axis to the circumferential surface;

a feed roller supported by the shaft and configured to rotate in a sheet-feeding direction;

a lever disposed at the another end portion of the shaft, the feed roller being positioned between the insertion part and the lever in the axial direction, the lever including a grip part extending in the radial direction; and a first one-way clutch allowing the lever to idly rotate relative to the shaft in a sheet-returning direction opposite to the sheet-feeding direction; and a main body supporting the sheet feeding assembly, the main body comprising:

a reverse roller facing the feed roller and configured to rotate in the sheet-returning direction;

a first contact part positioned downstream relative to the grip part in the sheet-returning direction and contacting the grip part;

a rotary part configured to rotate about the rotation axis upon transmission of a drive force, the rotary part including a hole portion and a first wall, the hole portion being configured to receive the insertion part, the first wall being configured to contact the prescribed surface but to be separated from the circumferential surface when the insertion part has been inserted into the hole portion, the rotary part having one end and another end in the axial direction, the one end of the rotary part being closer to the feed roller than the another end of the rotary part to the feed roller in the axial direction;

a first bearing disposed between the feed roller and the rotary part in the axial direction, the first bearing including an open portion having an inner curved surface on which the shaft is rotatably supported, an opening of the open portion having a dimension in the circumferential direction greater than an outer diameter of the shaft;

a second bearing disposed opposite to the first bearing and the rotary part with respect to the feed roller in the axial direction, the second bearing supporting the shaft at a position between the feed roller and the lever, the shaft being slidable in the axial direction relative to the second bearing; and an indentation wall disposed opposite to the feed roller with respect to the second bearing in the axial direction, the indentation wall being indented in the radial direction and extending in the axial direction, the indentation wall having one end and another end in the axial direction, the one end of the indentation wall being farther from the feed roller than the another end of the indentation wall from the feed roller in the axial direction, a distance from the one end of the indentation wall to the one end of the rotary part being greater than a dimension of the shaft in the axial direction, wherein the shaft is configured to be slidingly movable in the axial direction between a mounted position and a retracted position while the shaft is supported by the fist bearing and the second bearing, the feed roller and the lever moving in the axial direction in conjunction with the sliding movement of the shaft between the mounted position and the retracted position, and wherein the insertion part is separated in the axial direction from the hole portion when the shaft is in the retracted position, the insertion part being inserted into the hole portion to allow the shaft to be placed in the mounted position.

2. The sheet feeder according to claim 1, wherein the lever is configured to pivotally move in the circumferential direction about the rotation axis between a first pivot position and a second pivot position when the shaft is in the mounted position, wherein the lever is further configured to pivotally move in the circumferential direction about the rotation axis between the second pivot position and a third pivot position when the shaft is in the retracted position, and wherein the grip part is in contact with the first contact part when the lever is in the first pivot position, the second pivot position being located further downstream relative to the first pivot position in the sheet-feeding direction, the third pivot position being located between the first pivot position and the second pivot position in the sheet-feeding direction.

3. The sheet feeder according to claim 2, wherein the lever includes a locking arm positioned further downstream relative to the grip part in the sheet-returning direction, the locking arm including a first extension part extending in the radial direction and a second extension part extending from the first extension part in a direction crossing the radial direction, wherein the indentation wall has an aperture extending in the circumferential direction, a distance from the indentation wall to the rotation axis in the radial direction being smaller than a distance from the second extension part to the rotation axis in the radial direction, the aperture being positioned between the locking arm and the feed roller in the axial direction when the shaft is in the retracted position, the aperture being aligned with the locking arm in the axial direction when the shaft is in the mounted position, wherein the first extension part passes through the aperture when the shaft is in the mounted position and the lever pivotally moves from the second pivot position to the first pivot position, and wherein the second extension part contacts the main body when the shaft is in the retracted position and the lever is in the third pivot position, the second extension part being positioned opposite to the rotation axis with respect to the indentation wall in the radial direction when the shaft is in the mounted position and the lever is in the first pivot position.

4. The sheet feeder according to claim 3, wherein the lever includes a first engaging part protruding from the grip part in a direction from the second pivot position to the first pivot position, and wherein the main body includes a second engaging part, the second engaging part being engageable with the first engaging part when the shaft is in the mounted position and the lever is in the first pivot position.

5. The sheet feeder according to claim 3, wherein the axial direction includes a first axial direction from the lever to the feed roller, and wherein the indentation wall has an opposing surface positioned upstream relative to the aperture in the first axial direction and opposing the aperture in the first axial direction, the opposing surface being positioned adjacent to the locking arm in the first axial direction.

6. The sheet feeder according to claim 3, wherein the grip part has a first portion facing in the sheet-feeding direction, wherein the main body includes a cover configured to be pivotally movable between a closed position and an open position, the cover in the closed position covering the sheet feeding assembly in the radial direction, the cover in the open position exposing the sheet feeding assembly to an outside in the radial direction, the cover including a protrusion protruding in a direction from the open position to the closed position, the protrusion being configured to contact the first portion of the grip part, and wherein the first portion drawing a first trajectory when the shaft is in the mounted position and the lever pivotally moves from the second pivot position to the first pivot position, the protrusion drawing a second trajectory when the cover pivotally moves from the open position to the closed position, the second trajectory overlapping the first trajectory in its entire range in the circumferential direction.

7. The sheet feeder according to claim 6, wherein the lever includes a second contact part positioned downstream relative to the grip part in the sheet-feeding direction, the second contact part being configured to contact the main body from an upstream side relative to the main body in the sheet-feeding direction when the lever is in the second pivot position, and wherein the protrusion is positioned downstream relative to the first portion in the sheet-feeding direction.

8. The sheet feeder according to claim 1, wherein the lever includes a first cylindrical part from which the grip part extends, the shaft extending through the first cylindrical part, the first cylindrical part having an internal space in which the first one-way clutch is accommodated, and wherein the first cylindrical part has a first length in the axial direction, the indentation wall having a second length in the axial direction, the first length being smaller than the second length.

9. The sheet feeder according to claim 8, wherein lever includes a second cylindrical part disposed between the first cylindrical part and the feed roller in the axial direction, the second cylindrical part covering an outer circumferential surface of the shaft and extending in the axial direction, wherein the second cylindrical part has an outer diameter smaller than an outer diameter of the first cylindrical part, and wherein the second bearing supports the shaft through the second cylindrical part.

10. The sheet feeder according to claim 1, wherein the axial direction includes a first axial direction from the another end portion of the shaft to the one end portion of the shaft, wherein the shaft has a first axial segment positioned downstream relative to the feed roller in the first axial direction and including the one end portion of the shaft, wherein the first bearing has one end and another end in the axial direction, the one end of the first bearing being positioned farther from the rotary part than the another end of the first bearing from the rotary part in the axial direction, wherein the rotary part has one end and another end in the axial direction, the one end of the rotary part being positioned farther from the first bearing than the another end of the rotary part from the first bearing in the axial direction, and wherein the first axial segment has a length in the axial direction equal to a distance from the one end of the first bearing to the one end of the rotary part in the axial direction.

11. The sheet feeder according to claim 1, wherein the prescribed surface comprises a first prescribed surface and a second prescribed surface, the second prescribed surface being disposed opposite to the first prescribed surface with respect to the rotation axis, the first prescribed surface having a first end extending in the axial direction and a second end extending in the axial direction, the second prescribed surface having a third end extending in the axial direction and a fourth end extending in the axial direction, wherein the circumferential surface comprises a first circumferential surface and a second circumferential surface, the first circumferential surface extending in the circumferential direction from the first end of the first prescribed surface and connected to the third end of the second prescribed surface, the second circumferential surface extending in the circumferential direction from the second end of the first prescribed surface and connected to the fourth end of the second prescribed surface, and wherein the insertion part is accommodated in the hole portion such that one of the first prescribed surface and the second prescribed surface faces the first wall in the circumferential direction.

12. The sheet feeder according to claim 1, wherein the sheet feeding assembly further comprises a second one-way clutch disposed between the shaft and the feed roller in the radial direction, the second one-way clutch being configured to restrict the feed roller to idly rotate relative to the shaft in the sheet-returning direction.

13. A sheet feeding assembly configured to be mounted in a main body of a sheet feeder, the sheet feeding assembly comprising:

a shaft configured to rotate about a rotation axis extending in an axial direction, the shaft having one end portion and another end portion in the axial direction, the one end portion having an insertion part, the insertion part including a prescribed surface and a circumferential surface, the prescribed surface facing in a radial direction of the shaft, the prescribed surface having one end extending in the axial direction and another end extending in the axial direction, the circumferential surface extending in a circumferential direction of the shaft from the one end of the prescribed surface and the another end of the prescribed surface, a distance in the radial direction from the rotation axis to a portion of the prescribed surface except for the one end of the prescribed surface and the another end of the prescribed surface being smaller than a distance in the radial direction from the rotation axis to the circumferential surface;

a roller supported by the shaft and configured to rotate in a sheet-feeding direction;

a lever disposed at the another end portion of the shaft, the roller being positioned between the insertion part and the lever in the axial direction, the lever including:

a grip part extending in the radial direction; and a locking arm positioned further downstream relative to the grip part in a sheet-returning direction opposite to the sheet-feeding direction, the locking arm including a first extension part extending in the radial direction and a second extension part extending from the first extension part in a direction crossing the radial direction;

a first one-way clutch allowing the lever to idly rotate relative to the shaft in the sheet-returning direction; and a second one-way clutch disposed between the shaft and the roller in the radial direction, the second one-way clutch being configured to restrict the roller to idly rotate relative to the shaft in the sheet-returning direction.

14. A method of mounting a sheet feeding assembly in a main body of a sheet feeder, the method comprising:

(a) providing the sheet feeding assembly and the main body, the sheet feeding assembly comprising:

a shaft configured to rotate about a rotation axis extending in an axial direction, the shaft having one end portion and another end portion in the axial direction, the one end portion having an insertion part, the insertion part including a prescribed surface and a circumferential surface, the prescribed surface crossing in a radial direction of the shaft, the prescribed surface having one end extending in the axial direction and another end extending in the axial direction, the circumferential surface extending in a circumferential direction of the shaft from the one end of the prescribed surface and the another end of the prescribed surface, a distance in the radial direction from the rotation axis to a portion of the prescribed surface except for the one end of the prescribed surface and the another end of the prescribed surface being smaller than a distance in the radial direction from the rotation axis to the circumferential surface, the shaft being configured to be movable in the axial direction between a mounted position and a retracted position;

a feed roller supported by the shaft and configured to rotate in a sheet-feeding direction;

a lever disposed at the another end portion of the shaft, the feed roller being positioned between the insertion part and the lever in the axial direction, the lever including:

a grip part extending in the radial direction and having a first portion facing in the sheet-feeding direction; and a locking arm positioned further downstream relative to the grip part in a sheet-returning direction opposite to the sheet-feeding direction, the locking arm including a first extension part extending in the radial direction and a second extension part extending from the first extension part in a direction crossing the radial direction; and a first one-way clutch allowing the lever to idly rotate relative to the shaft in the sheet-returning direction; and the main body comprising:

a reverse roller facing the feed roller and configured to rotate in the sheet-returning direction;

a first contact part positioned downstream relative to the grip part in the sheet-returning direction and contacting the grip part;

a rotary part configured to rotate about the rotation axis upon transmission of a drive force, the rotary part comprising:

a hole portion configured to receive the insertion part; and a first wall configured to contact the prescribed surface but to be separated from the circumferential surface when the insertion part has been inserted into the hole portion, the rotary part having one end and another end in the axial direction, the one end of the rotary part being closer to the feed roller than the another end of the rotary part to the feed roller in the axial direction;

a first bearing disposed between the feed roller and the rotary part in the axial direction, the first bearing including an open portion having an inner curved surface on which the shaft is rotatably supported, an opening of the open portion having a dimension in the circumferential direction greater than an outer diameter of the shaft;

a second bearing disposed opposite to the first bearing and the rotary part with respect to the feed roller in the axial direction, the second bearing supporting the shaft at a position between the feed roller and the lever, the shaft being slidable in the axial direction relative to the second bearing;

an indentation wall disposed opposite to the feed roller with respect to the second bearing in the axial direction, the indentation wall being recessed in the radial direction and extending in the axial direction, the indentation wall having one end and another end in the axial direction, the one end of the indentation wall being farther from the feed roller than the another end of the indentation wall from the feed roller in the axial direction, a distance from the one end of the indentation wall to the one end of the rotary part being greater than a dimension of the shaft in the axial direction, a distance from the indentation wall to the rotation axis in the radial direction being smaller than a distance from the second extension part to the rotation axis in the radial direction, the indentation wall has an aperture extending in the circumferential direction, the aperture being positioned between the locking arm and the feed roller in the axial direction when the shaft is in the retracted position, the aperture being aligned with the locking arm in the axial direction when the shaft is in the mounted position, the insertion part being separated in the axial direction from the hole portion when the shaft is in the retracted position, the insertion part being inserted into the hole portion to allow the shaft to be placed in the mounted position; and a cover configured to be pivotally movable between a closed position and an open position, the cover in the closed position covering the sheet feeding assembly in the radial direction, the cover in the open position exposing the sheet feeding assembly to an outside in the radial direction, the cover including a protrusion protruding in a direction from the open position to the closed position, the protrusion being configured to contact the first portion of the grip part;

(b) placing the sheet feeding assembly in the main body so that the shaft is placed in the retracted position and supported by the first bearing and the second bearing;

(c) moving the sheet feeding assembly in the axial direction while the shaft is supported by the first bearing and the second bearing so that the shaft is placed in the mounted position; and (d) moving the cover from the open position to the closed position, the protrusion pressing the first portion of the grip part to move the lever to the first pivot position in conjunction with the movement of the cover from the open position to the closed position, the grip part being in contact with the first contact part when the lever is in the first pivot position, the first extension part passing through the aperture in conjunction with the movement of the lever to the first pivot position, the second extension part being moved to a position opposite to the rotation axis with respect to the indentation wall in the radial direction in conjunction with the movement of the lever to the first pivot position.

* * * * *